US005734949A

United States Patent [19]

Goto et al.

[11] Patent Number: 5,734,949

[45] Date of Patent: Mar. 31, 1998

[54] PROCESS CARTRIDGE AND IMAGE FORMING APPARATUS USABLE WITH THIS PROCESS CARTRIDGE

[75] Inventors: Shinji Goto, Yokohama; Jun Saito, Kawasaki; Hiroyuki Ishii, Yokohama; Masao Ando, Yokohama; Yoshiaki Watanabe, Yokohama; Yuzo Isoda, Yokohama; Masahide Tanoue, Yokohama; Ryukichi Inoue, Kawasaki, all of Japan

[73] Assignee: Canon Kabushiki Kaisha, Tokyo, Japan

[21] Appl. No.: 754,630

[22] Filed: Nov. 21, 1996

Related U.S. Application Data

[63] Continuation of Ser. No. 295,087, Aug. 24, 1994, abandoned, which is a continuation of Ser. No. 905,552, Jun. 25, 1992.

[30] Foreign Application Priority Data

| | | | |
|---|---|---|---|
| Jun. 28, 1991 | [JP] | Japan | 3-183933 |
| Feb. 28, 1992 | [JP] | Japan | 4-079243 |
| Jun. 4, 1992 | [JP] | Japan | 4-144484 |

[51] Int. Cl.[6] ..... G03G 21/16

[52] U.S. Cl. ..... 399/111

[58] Field of Search ..... 399/111, 110, 399/119, 125; 347/138

[56] References Cited

U.S. PATENT DOCUMENTS

| | | | |
|---|---|---|---|
| 3,985,436 | 10/1976 | Tanaka et al. | 355/200 |
| 4,785,319 | 11/1988 | Fujino et al. | 346/145 X |
| 4,873,548 | 10/1989 | Kobayashi et al. | 355/200 |
| 4,912,563 | 3/1990 | Narita | 355/200 |
| 4,952,989 | 8/1990 | Kawano et al. | 355/210 |
| 5,047,803 | 9/1991 | Kanoto | 355/211 |
| 5,115,272 | 5/1992 | Ohmori et al. | 355/200 |
| 5,331,373 | 7/1994 | Nomura et al. | 355/210 X |
| 5,452,056 | 9/1995 | Nomura et al. | 355/210 X |
| 5,500,714 | 3/1996 | Yashiro et al. | 355/200 |

FOREIGN PATENT DOCUMENTS

| | | |
|---|---|---|
| 0276910 | 8/1988 | European Pat. Off. . |
| 0285139 | 10/1988 | European Pat. Off. . |
| 0397465 | 11/1990 | European Pat. Off. . |
| 0405514 | 1/1991 | European Pat. Off. . |
| 0407183 | 1/1991 | European Pat. Off. . |
| 3236854 | 4/1983 | Germany . |
| 62-186274 | 8/1987 | Japan . |
| 1-229270 | 9/1989 | Japan . |
| 3-98061 | 4/1991 | Japan . |
| 3-252665 | 11/1991 | Japan . |
| 3-252667 | 11/1991 | Japan . |
| 3-252668 | 11/1991 | Japan . |
| 3-252669 | 11/1991 | Japan . |
| 4-70767 | 3/1992 | Japan . |
| 4-90561 | 3/1992 | Japan . |

OTHER PUBLICATIONS

Patent Abstracts of Japan, vol. 15, No. 287 (Jul. 22, 1991).
Patent Abstracts of Japan, vol. 12, No. 34 (Feb. 2, 1988).
Patent Abstracts of Japan, vol. 13, No. 550 (Dec. 8, 1989).

*Primary Examiner*—S. Lee
*Attorney, Agent, or Firm*—Fitzpatrick, Cella, Harper & Scinto

[57] ABSTRACT

A process cartridge is detachably mountable to an image forming apparatus for forming an image on a recording material. The process cartridge includes an image bearing member, a process device for acting on the image bearing member, which includes a developing device for developing an image on the image bearing member, a frame, and a projection disposed on the upper surface of the frame and extending toward the developing device, the projection having (i) an upward inclined surface, (ii) a flat surface continuing from the upper inclined surface, and (iii) a downward inclined surface that is inclined toward the developing device.

6 Claims, 19 Drawing Sheets

PROCESS CARTRIDGE AND IMAGE FORMING APPARATUS USABLE WITH THIS PROCESS CARTRIDGE

This application is a continuation of application Ser. No. 08/295,087, filed Aug. 24, 1994, now abandoned, which in turn is a continuation of application Ser. No. 07/905,552, filed Jun. 25, 1992, now pending.

FIELD OF THE INVENTION AND RELATED ART

The present invention relates to a process cartridge and an image forming apparatus usable with the process cartridge.

As the image forming apparatus in this case, an electrophotographic copying machine, facsimile machine, laser beam printer, word processor, and the like, for example, are included.

In the case of an image forming apparatus using an electrophotographic system, a photosensitive drum which is the image carrier, and process means such as a developing device, cleaning device, and the like are integrated to form a process cartridge unit. This process cartridge can be freely loaded into or unloaded from the main structure of the image forming apparatus. This type of process cartridge can simplify the maintenance by being able to be totally exchanged with a fresh process cartridge when toner within the developer device is exhausted, when the cleaning device is filled up with waste toner, or when the like situation occurs (for example, U.S. Pat. No. 3,985,436).

It is conceivable to interlock the operation for loading such a process cartridge into the apparatus main assembly to the opening/closing operation of the main assembly cover. One such example is explained, referring to FIG. 28. In the figure, reference numeral 200 designates a guide member (a pair of them are provided in the direction perpendicular to the page of FIG. 28, but only one side is shown in the figure) which guides the process cartridge to its proper loading location within the apparatus main assembly 300. This guide member 200 is supported in the apparatus main assembly by a spindle 201 so as to pivot freely. Also, there is provided on this guide member 200, a linking mechanism which works interlockingly with the opening/closing movement of the main assembly cover 301 of the apparatus main assembly 300. Therefore, the guide member 200 is made to rotate by this linking mechanism from the location (I) outlined by the solid line to location (RO) outlined by the chain line when the main assembly cover 301 is opened. Then, it rotates to the location (I) outlined by the solid line as the main assembly cover 301 is closed.

In other words, a guided protrusion provided on the side surface of the process cartridge is inserted into a groove section 202 provided on the guide member 200 (one at the location (RO) outlined by the chain line), and the process cartridge is pushed in along this groove 202, whereby this process cartridge is supported by the guide member 200 and properly positioned. Then, the guide member 200 is moved by the linking mechanism to the location (I) outlined by the solid line when the main assembly cover 301 is closed, and the process cartridge is pressed into the proper location, with its outwardly protruding drum shaft being supported by drum shaft bearing sections 220 of the apparatus main assembly 300.

The process cartridge is provided with a drum shutter which shields light to protect the photosensitive drum when it is taken out of the apparatus main assembly 300, and this drum shutter must be opened or closed as the process cartridge is loaded into or unloaded from the apparatus main assembly 300. Therefore, a cam member provided on the apparatus main assembly 300 to open or close this drum shutter is provided on the side of the above mentioned guide member 200, for reliable opening or closing of the shutter.

However, in the case of the structure of the above mentioned technical background, the guided protrusion of the process cartridge must be fitted into the groove section 202 of the guide member when the process cartridge is to be inserted into the apparatus main assembly 300, which creates a problem in that it is not easy to operate. Also, the process cartridge supported by the guide member 200 is lifted or pressed down, in interrelation with the opening or closing operation of the main assembly cover. Therefore, its load is imparted to the main assembly cover 101, making it necessary for this main assembly cover 301 or its hinge section to be given a structure with higher rigidity. Further, the main assembly cover 301 feels heavy when it is opened or closed, which is unfavorable.

In addition, the following loading/unloading mechanism has been thought of as the background technology of the present invention.

A representative example of the mechanism for loading or unloading the process cartridge into or out of the copying apparatus (image forming apparatus) is shown in FIG. 29 and FIG. 30.

FIG. 29 is an explanatory drawing showing the essential section of the copying apparatus. In the drawing, the process cartridge 252 outlined by the two-dot chain line indicates its location before it is inserted into the apparatus main assembly, and the process cartridge 252 outlined by the solid line indicates its loaded location in the apparatus main assembly.

Also, a pair of guide members 253 are affixed to the main assembly of the copying apparatus, facing both side wall sections of the process cartridge 252 to be loaded. This guide member 253 is equipped with rail section **253*a* which is extended along the loading direction of the process cartridge 252. This rail section 253*a* regulates the sliding passage of this process cartridge 252 since it remains engaged with the protrusive section (first engaged member) 252*a* formed on the process cartridge 252 while the process cartridge 252 is slid. Further, a shaft bearing section 253*b* is continuously found at the lower end of the rail section 253*a*. This shaft bearing section 253*b* is shaped so as to fit a rotative shaft 254*a***.

Also, two positioning members 255 and 256 are affixed to the apparatus main assembly. The positioning member 255 of these two is supported by the apparatus main assembly so as to be able to rotate around a rotational axis **255*a* as well as being pressed in the clockwise direction, thereby pressing in the clockwise direction the end section of the process cartridge 252 at the loaded location. Further, the positioning member 256 is affixed to the apparatus main assembly, and fits into the concave section formed on the upper wall section of this process cartridge 252 when the process cartridge 252** is at its proper loading location.

On the other hand, as is shown in FIG. 30, the rotative shaft **254*a* of the photosensitive drum 254 sticks out of both side wall sections of the process cartridge 252, wherein the rotative shaft 254*a* is fitted into the shaft bearing section 253*b* when the process cartridge 252 is at its proper loading location. Further, the pressing member 257 shown in the figure is a spring member attached to the apparatus main assembly, and its free end is made to contact one of the side wall sections of the process cartridge 252, whereby the process cartridge 252 is moved by the pressure of the pressing member 257 in the direction indicated by the arrow, so that it is retained in the condition in which one end surface of the rotative shaft 254***a* remains in contact with the end surface of the shaft bearing section 253*b*. With this arrangement, the location of the process cartridge 252 is regulated in the crosswise direction relative to its sliding direction (hereinafter, described as "thrust direction").

According to the above described structure, when the protrusive section 252*a* of the process cartridge 252 is placed at the location outlined by the two-dot chain line on the rail section 253*a* on the side of the apparatus main assembly 300 in FIG. 29, this process cartridge 252 slides along the rail section 253*a*. Next, this process cartridge 252 is properly positioned in the sliding direction by the positioning members 255 and 256 when this process cartridge 252 is slid up to its proper loading location. Further, the rotative shaft 254*a* is fitted into the shaft bearing section 253*b*, whereby the rotational center of the process cartridge 252 is properly positioned. At this time, the process cartridge is also properly positioned in the thrust direction since the pressing member 257 remains in contact with one of the side wall sections of the process cartridge.

However, according to the above mentioned background technology, the process cartridge 252 in its loading location is constantly pressured by the pressing member 257 in the thrust direction. In addition, the pressure of this pressing member 257 is a force strong enough to move the process cartridge 252 against its friction. Therefore, the casing of the process cartridge 252 must have strong rigidity so as not to deform under the pressure from the pressing member 257.

Further, a pressure is also imparted on the process cartridge 252 from the positioning member 255, but since the pressure from the above mentioned pressing member 257 is imparted in the perpendicular direction to this pressure, it becomes difficult for this process cartridge 252 to rotate. Therefore, there is a problem in that positioning cannot be precisely performed by the positioning member 255.

SUMMARY OF THE INVENTION

Accordingly, a principal object of the present invention is to provide a process cartridge and an image forming apparatus, with substantially improved operational efficiency at the time of loading the cartridge into the image forming apparatus.

Another object of the present invention is to provide a process cartridge and an image forming apparatus, which can reduce the load imparted on the apparatus main assembly when the process cartridge is loaded into the image forming apparatus main assembly.

Another object of the present invention is to provide a process cartridge and an image forming apparatus, which can not only make loading and unloading of the process cartridge simple and reliable but also reduce the load imparted on the main assembly cover.

Another object of the present invention is to provide a process cartridge and an image forming apparatus, which enables the process cartridge to be precisely positioned in the image forming apparatus main assembly during the loading operation.

Another object of the present invention is to provide a process cartridge and an image forming apparatus, wherein pressure is not imparted on the process cartridge in its proper loading location, so that the process cartridge can be precisely positioned.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Below, each of preferred embodiments in accordance with the present invention is explained, with reference to the drawings.

To begin with, a first preferred embodiment in accordance with the present invention is explained, referring to FIG. 1 to FIG. 7.

Figure 1:
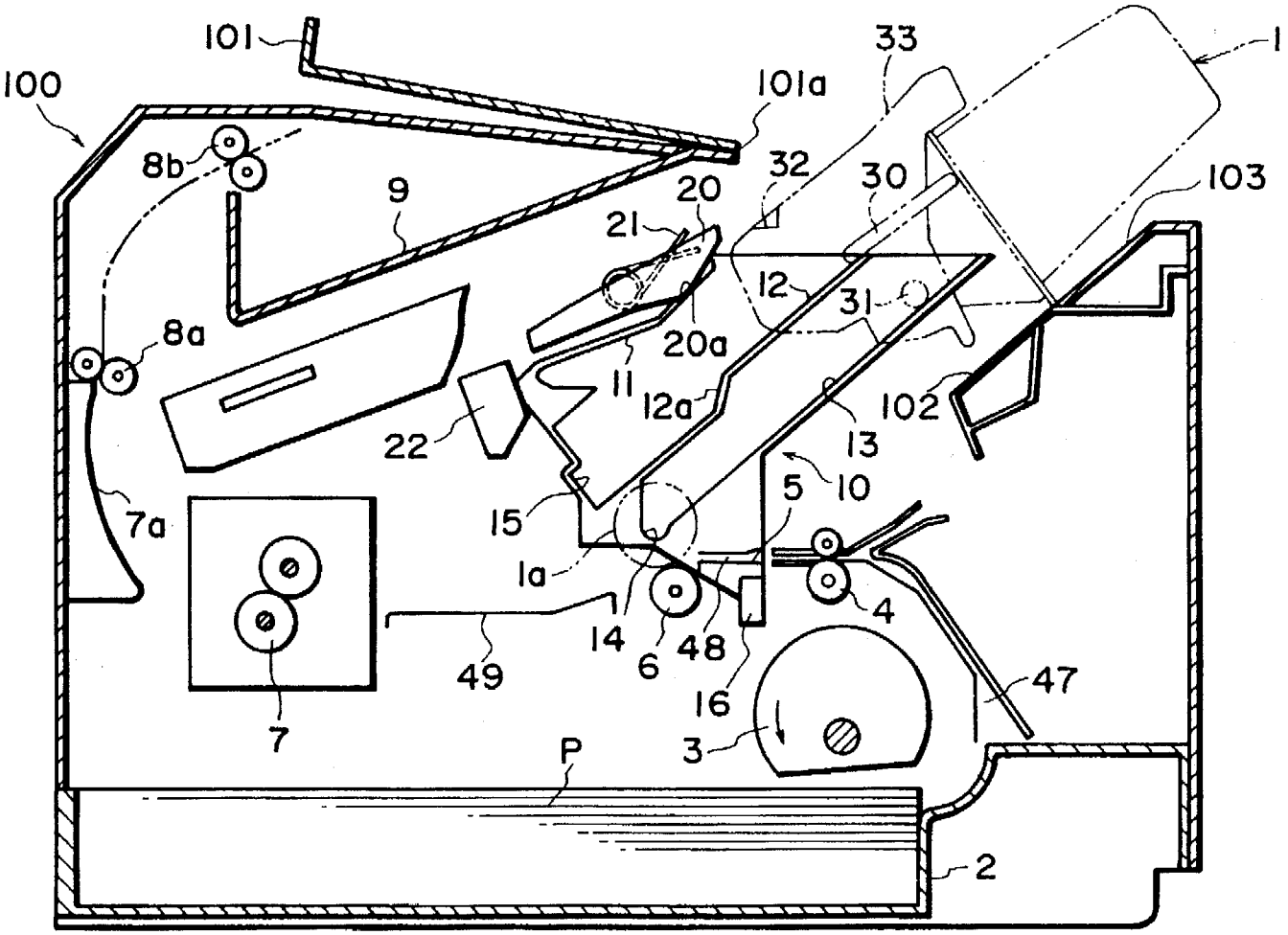
FIG. 1 is a sectional view of an image forming apparatus in accordance with a preferred embodiment of the present invention.

FIG. 1 shows a sectional side view of an image forming apparatus. In the figure, reference numeral 1 is a process cartridge in which process devices for image forming, such as a photosensitive drum, developing device, cleaning device, and charging device, are provided as an integrated unit, and which can be freely loaded into or unloaded out of an apparatus main assembly 100. This process cartridge 1 is positioned in the proper loading location by being guided and pressed by a guide member 10, pressing member 20, and the like, which are provided in the apparatus main assembly 100. Incidentally, the process cartridge 1 in the state shown in FIG. 1 is yet to be loaded into the apparatus main assembly 100. Further, the location of the photosensitive drum 1*a* contained in the process cartridge 1 in its proper loading location is outlined in the middle section of the apparatus main assembly 100 by the two-dot chain line. There provided on the feeding side of the above mentioned photosensitive drum 1*a* are a feed cassette 2, feed roller 3, resist roller 4, transfer guide 5, and transfer roller 6. Further, there provided on the paper delivery side are a fixing device 7, guide 7*a*, conveying roller 8*a*, delivery roller 8*b*, delivery tray 9, and the like. The electrostatic latent image is formed on the photosensitive drum 1*a* by the image forming beam irradiated corresponding to the image signal from the host apparatus, and is developed by the developing device, appearing as a toner image. This toner image moves to the transfer roller 6 as the photosensitive drum 1*a* rotates, and is transferred onto transfer paper P by this transfer roller 6. At this time, the transfer paper P in feed cassette 2 is sent out piece by piece in the rotational direction (arrow mark direction) of the feed roller 3, is delivered to the resist roller 4, and then, is fed between the photosensitive drum 1*a* and the transfer roller 6 after its timing is adjusted by this resist roller 4. Then, the toner image on the photosensitive drum 1*a* is transferred onto the transfer paper P and the transfer paper P is sent to the fixing device 7 after the completion of transfer process. After the toner image is fixed as a permanent image by this fixing device 7, the paper is delivered by the delivery roller 8 to delivery tray 9 where it accumulates. Incidentally, reference numerals 47, 48 and 49 in the figure are paper guides.

Next, the mechanism for loading or unloading the process cartridge 1 into or out of the apparatus main assembly 100 is explained.

The loading/unloading mechanism is provided below the main assembly cover 101 which can be freely opened or closed around hinge 101*a* in the vertical direction. This loading/unloading mechanism comprises guide members 10 which are diagonally arranged, pressing members 20, stopper members 22, and the like, which are provided on the upper end side of the guide members 10. This loading/unloading mechanism allows the process cartridge 1 in the state of being pressed onto the guide member 10 by the pressing member 20 to be loaded or unloaded along this guide member 10. These guide members 10 and pressing members 20 are provided on both side surfaces of the apparatus main assembly 100, one on each side surface, and support the process cartridge 1, thereby properly positioning both of its side sections. However, only one side is explained below for brevity. The other side has the same configuration.

Further, at the upper right of the guide member 10 in FIG. 1, a bridge member 102 which bridges between both side walls of the apparatus main assembly 10, and a diagonal exterior plate 103 which extends from this bridge member 102, are diagonally arranged in parallel to the guide members 10, and constitute the section for guiding the process cartridge 1 into the loading/unloading mechanism.

Further, the guide member 10 is formed, for example, of resin, and its upper, middle, lower, and under sections, except the upper section which is the loading opening of the process cartridge 1, are formed to protrude perpendicularly toward this side of the page of the figure. On the upper side section, a cam section 11 for opening the drum shutter of the process cartridge 1 is provided, and on the upper surface of the protrusion in the middle section, a first guide surface 12 is provided, which positions by pressure this process cartridge 1 in the loading/unloading direction of the process cartridge 1. Further, since a downward step is provided on the middle section of the protrusion, it results in that step section 12*a* is also formed on the first guide surface 12.

Also on the upper surface of the protrusion of the lower side section of the guide member 10, a second guide surface 13, which is similar to the above, is provided in parallel to the first guide surface 12, for positioning the process cartridge 1 by pressure, and at its lower end section, drum shaft bearing section 14 which is circularly concaved downward is provided. Further, a support surface 15 for unloading the process cartridge 1 is provided on the under side and the inner surface of the protrusion, on the upper side of the drum shaft bearing section 14. In addition, guide holder section 16 for supporting and positioning the molded resin transfer guide 5 is provided below the drum shaft bearing section 14, and precise positioning of the transfer guide 5 relative to the photosensitive drum 1*a*, exchanging of the transfer guide 5, and such, can be easily performed by the presence of this guide holder section 16.

Further, the pressing member 20 is provided above the cam section 11 in line with this guide member 10, and its tip section, pressing section 20*a*, is pressed downward by a guide pressing spring 21. Also, a stopper member 22 for positioning the process cartridge 1 is provided at the lower end side of the guide member 10.

In the figure, the process cartridge 1 is outlined by the chain line, and on both of its side surfaces, first protrusive section 30, which is thin and long, and which moves following the first guide surface 12 of the above mentioned guide member 10, is provided. In addition, a second protrusive section 31 (which is a protruding extension of the drum shaft of the photosensitive drum 1*a*) which moves following the second guide surface 13 of the guide member 10 is provided below this first protrusive section 31. Further, on the upper surface of the process cartridge 1, a positioning groove 32, which engages with stopper member 22, is provided, and on the upstream side of this positioning groove 32 in the loading direction of the process cartridge 1, a pressure bearing surface 33 which moves while bearing the pressure from the pressing section 20*a* of the pressing member 20 is provided.

Additionally, a drum shutter for protecting the photosensitive drum 1*a* is provided on the process cartridge 1, and the linking mechanism section of this drum shutter, which is interlocked with the loading or unloading operation of the process cartridge 1, is engaged with or discharged from the cam section 11 of the guide member 10, thereby opening or closing the drum shutter. Further, a driven gear for rotating the internal members is provided on the process cartridge, coaxially with the second protrusive section 31 which is the drum shaft, and when this process cartridge 1 is properly positioned in its loading location within the apparatus main assembly 100, this driven gear and the driving gear on the apparatus main assembly 100 side mesh with each other.

Next, the operation for loading this process cartridge 1 into the apparatus main assembly 100 and for unloading it from the apparatus main assembly 100 are explained, referring to FIG. 1 to FIG. 7.

Figure 2:
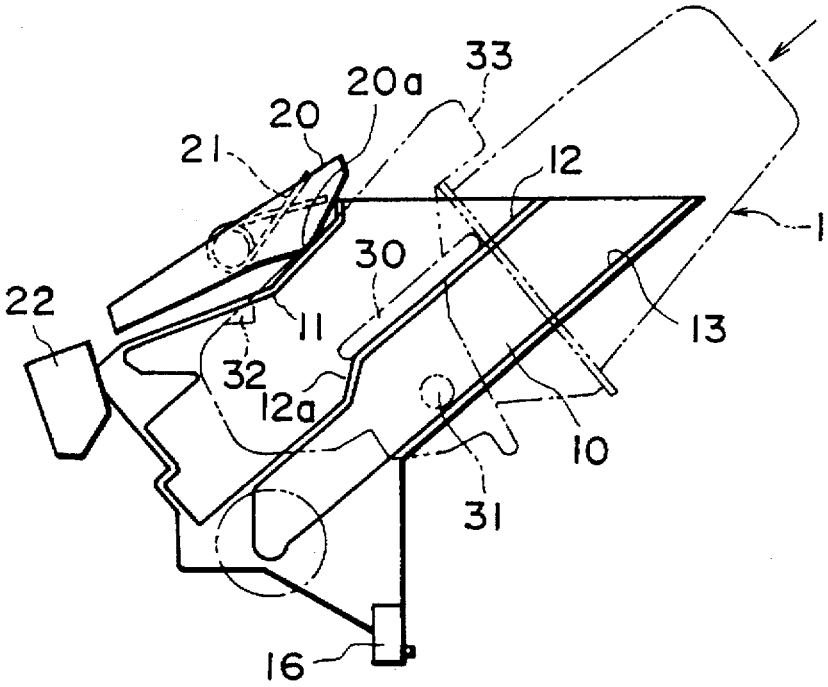
FIG. 2 is an explanatory view of the operation for loading or unloading the process cartridge into or out of the image forming apparatus.

First, the main assembly cover 101 is opened as is shown in FIG. 1. Then, the end section of the first protrusive section 30 of the process cartridge 1 is placed on the first guide surface 12 of the guide member 10, and the bottom section of the process cartridge 1 is placed on the guide section which comprises the bridging member 102 and the diagonal exterior plate 103. Next, as this process cartridge 1 is pushed inward of the apparatus main assembly 100, with the first protrusive section 30 of the process cartridge 1 being slid along the first guide surface 12, as is shown in FIG. 2, the pressure bearing surface 33 of the process cartridge 1 is pressed by the pressing section 20*a* of pressing member 20, whereby this process cartridge 1 is pressed at the first protrusive section 30 onto the first guide surface 12 of the guide member 10 and is moved inward of the apparatus main assembly 100, with its attitude being held steady.

Further, in this case, the second protrusive section 31 is located slightly above the second guide surface 13 of the guide member 10, and the process cartridge 1 is virtually supported by the first protrusive section 30 on the first guide surface 12.

Figure 3:
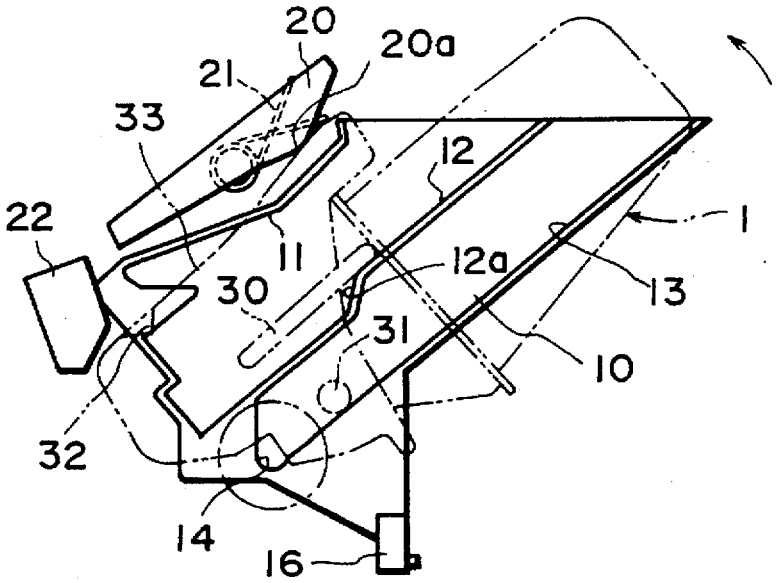
FIG. 3 is an explanatory view of the operation for loading or unloading the process cartridge into or out of the image forming apparatus.

As the process cartridge 1 is further pushed inward, as is shown in FIG. 3, the cam section 11 of the guide member 10 engages with the linking mechanism of the drum shutter of the process cartridge 1, whereby the drum shutter opens, as well as the first protrusive section 30 moves beyond the step section 12*a* of the first guide surface 12. Then, as the major portion of the first protrusive section 30 moves beyond the step section 12*a* of the first guide surface 12, the process cartridge 1 is slightly rotated counterclockwise in the figure by the pressure from the pressing member 20, and at this time, begins to be supported by the second protrusive section 31 on the second guide surface 13.

Figure 4:
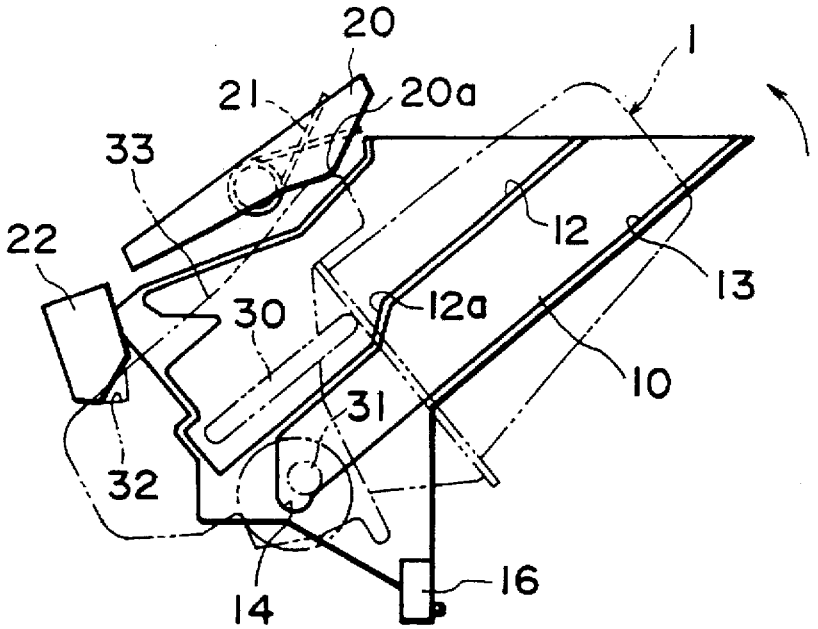
FIG. 4 is an explanatory view of the operation for loading or unloading the process cartridge into or out of the image forming apparatus.
Figure 5:
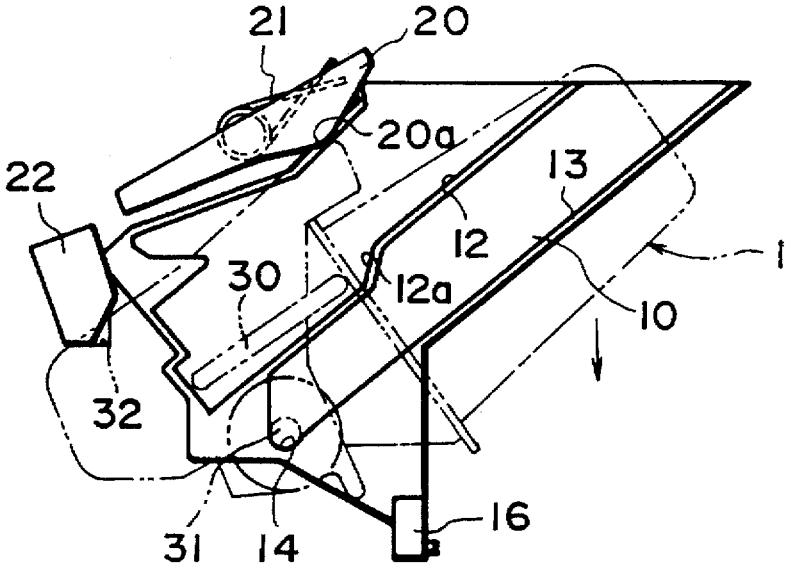
FIG. 5 is an explanatory view of the operation for loading or unloading the process cartridge into or out of the image forming apparatus.

As the process cartridge 1 is further pushed inward, the process cartridge 1 is further rotated slightly in the counterclockwise direction, as is shown in FIG. 4, and its upper section and the stopper member 22 come in contact with each other. Then, as the operator lets go of the process cartridge 1, the second protrusive section 31 of the process cartridge 1 is dropped into the drum shaft bearing section 14 of the guide member 10, and finally, the positioning/latching groove 32 of the process cartridge 1 engages with the stopper member 22, whereby the process cartridge 1 is properly positioned in its loading location within the apparatus main assembly 100, while it remains under the pressure from the pressing member 20 (refer to FIG. 5). Also, in this case, the contact between the first protrusion section 30 and the first guide surface 12, and the contact between the second protrusive section 31 and the second guide surface 13 are completely broken.

Also in this case, the pressure from the pressing member 20 imparted on this process cartridge 1 is eased as the process cartridge 1 drops in. Therefore, the operator can sense a clicking feel, thereby recognizing easily that this process cartridge 1 is properly positioned at its loading location. Further, when the process cartridge 1 drops in, the driven gear of this process cartridge and the driving gear on the apparatus main assembly 100 side smoothly engage with each other.

Next, the case in which the process cartridge 1 is unloaded from the apparatus main assembly 100 is explained.

Figure 6:
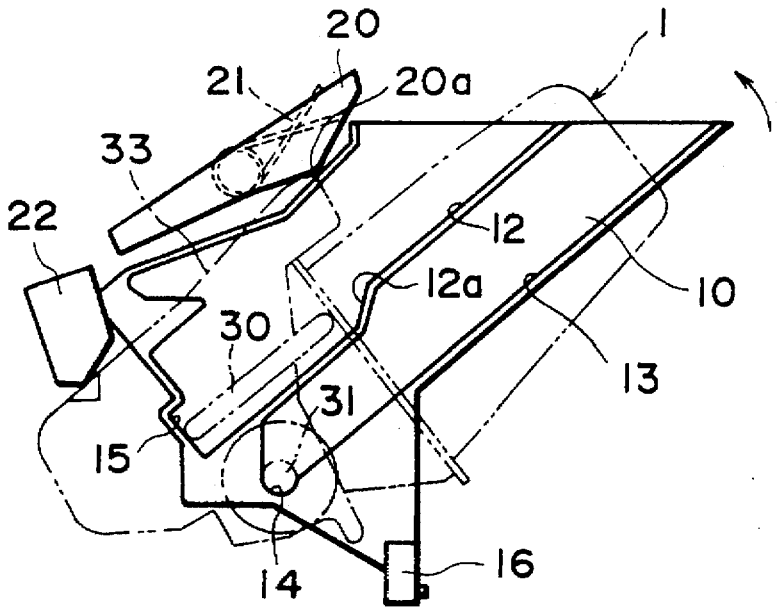
FIG. 6 is an explanatory view of the operation for loading or unloading the process cartridge into or out of the image forming apparatus.
Figure 7:
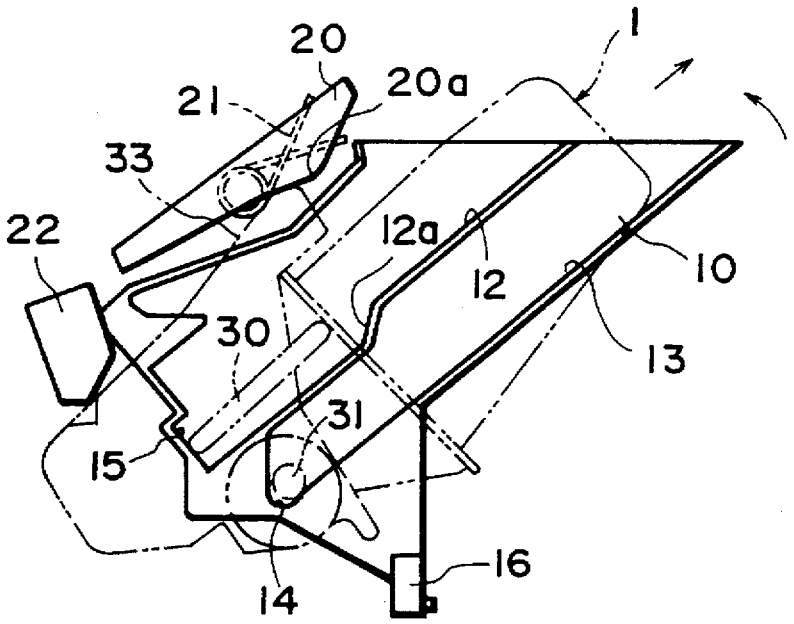
FIG. 7 is an explanatory view of the operation for loading or unloading the process cartridge into or out of the image forming apparatus.

When this process cartridge 1 is to be taken out of the apparatus main assembly 100, the operator slightly rotates the exposed upper section of the process cartridge 1 in the counterclockwise direction as is shown in FIG. 6, making the lower end section of the first protrusive section 30 come in contact with the support surface 15 of the guide member 10, and then, rotates the process cartridge 1 further in the counterclockwise direction, with this point of contact as the center of rotation, as is shown in FIG. 7. By this operation, the second protrusive section 31 of the process cartridge 1 is moved upward (3 to 6 mm) from the drum shaft bearing section 14, and simultaneously, the driven gear of the process cartridge 1 and the driving gear of the apparatus main assembly 100 are made to disengage from each other. Then, if this process cartridge 1 is pulled out in the direction following the first guide surface 12 and the second guide surface 13 of the guide member 10, this process cartridge 1 can be easily taken out of the apparatus main assembly 100. Further, in this case, the linking mechanism of the drum shutter is disengaged from the cam section 11 of the guide member 10, whereby the drum shutter is closed by the function of the spring member or the like.

Now then, when the process cartridge 1 is in the proper loading location within the apparatus main assembly 100, the driven gear of the process cartridge 1 receives a driving force with an approximately horizontal pressure angle, from the driving gear of the apparatus main assembly 100. Therefore, the engagement between two gears can be smoothly broken, as was described above, at the point where the second projection 31 of the process cartridge 1 has risen slightly above the drum shaft bearing section 14.

As was described above, when the process cartridge 1 is loaded, the process cartridge 1 can be inserted into the apparatus main assembly 100, with its attitude being held steady, just by pressing the first protrusive section 30 and the like of the process cartridge 1 onto the first guide surface 12 and the like formed on the side walls of the guide member 10. Therefore, the loading operation of the process cartridge 1 becomes easy, which increases the operational efficiency for loading or unloading this process cartridge 1. Also, when the process cartridge 1 is loaded, it is inserted into the apparatus main assembly 1 against the pressure from the pressing member 20, but since the direction of the pressure imparted on this process cartridge 1 and the direction of the process cartridge 1 insertion are approximately perpendicular to each other, the pressure does not amount to be too much of a resistance.

Further, when the process cartridge 1 is to be positioned at its loading location within the apparatus main assembly 100, the process cartridge 1 displaces slightly downward, which reduces the pressure from the pressing member 20. Therefore, the operation generates a clicking feel, which helps the operator easily recognize that the process cartridge 1 has been accurately positioned at its loading location. Also, when the operator lifts up the process cartridge 1 in order to take it out, since the rotational fulcrum can be established at the contact point, which is further inward of the drum shaft bearing section 14, between the lower end section of the protrusive section 30 and the support surface 15 of the guide member 10, and the point of lift can be established sufficiently outward from the pressure bearing point in the inserting direction, the force for lifting the process cartridge 1 may be small.

Moreover, according to this preferred embodiment, the locus of the process cartridge 1 during loading or unloading comprises the diagonal first locus along the first and the second guide surfaces 12 and 13 of the guide member 10, and the vertical second locus resulting from the movement of the second protrusive section 31 which drops into or is lifted from the drum shaft bearing section 14. Therefore, the engagement between the driven gear of the process cartridge 1 and the driving gear on the apparatus main assembly 100 side is naturally made by the pressure from the pressing member 20, regardless of the manner of inserting the process cartridge 1, easing the fear of damaging the gear surfaces when the process cartridge 1 is loaded.

Further, when the process cartridge 1 is loaded or unloaded, it is not necessary to interlock the functions of the guide member 10 or the pressing member 20 with the opening or closing movement of the main assembly cover 101. Therefore, not only may the structures of the main assembly cover 101 and its hinge sections be simple, but also, it is unnecessary for protrusive sections and the like to be provided on the under side of the main assembly cover 100.

Next, the second preferred embodiment in accordance with the present invention is explained, referring to FIG. 8 to FIG. 13. Incidentally, components with the same functions as those in the first embodiment are assigned the same reference numerals in order to make use of their previous explanations.

In the second preferred embodiment, the middle protrusive section (first guide surface 12) of the guide member 10 of the loading/unloading mechanism is eliminated, so that the process cartridge 1 is pressed onto this guide member 10 only at the second guide surface 13 (downward step 13*a* is formed in the middle). Also, a support section 17 for lifting the process cartridge 1 is provided at the lower end of the guide member 10. Also, on both side surfaces of the process cartridge 1, a third protrusive section 34 of a small diameter is provided in addition to the second protrusive section 31 which is the extension of the drum shaft. This third protrusive section 34 is provided on the upstream side of the second protrusive section 31 in the direction of inserting the process cartridge 1.

Figure 8:
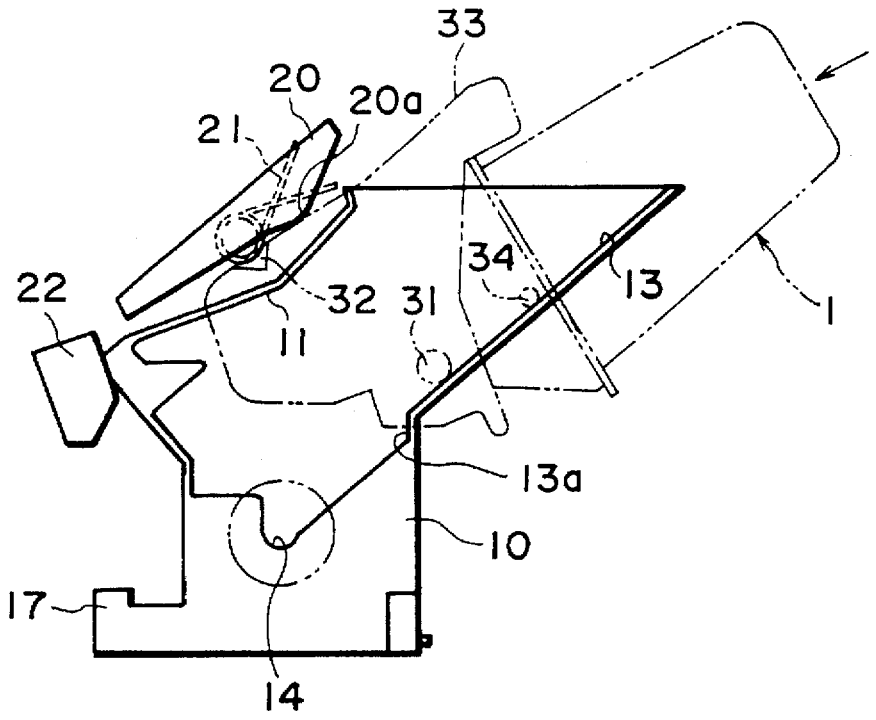
FIG. 8 is an explanatory view of the guide member and its related members in a preferred embodiment of image forming apparatus in accordance with the present invention.
Figure 9:
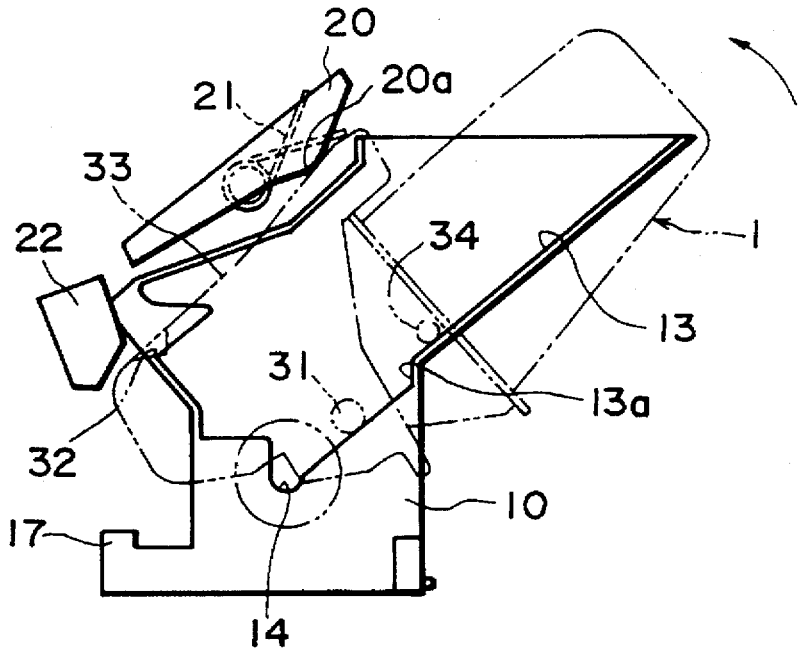
FIG. 9 is an explanatory view of the operation for loading or unloading the process cartridge into or out of the image forming apparatus.
Figure 10:
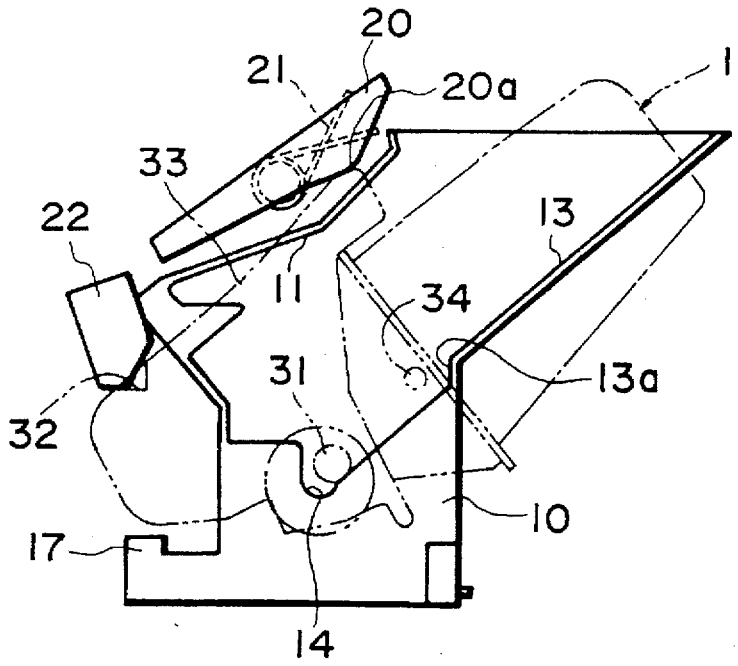
FIG. 10 is an explanatory view of the operation for loading or unloading the process cartridge into or out of the image forming apparatus.
Figure 11:
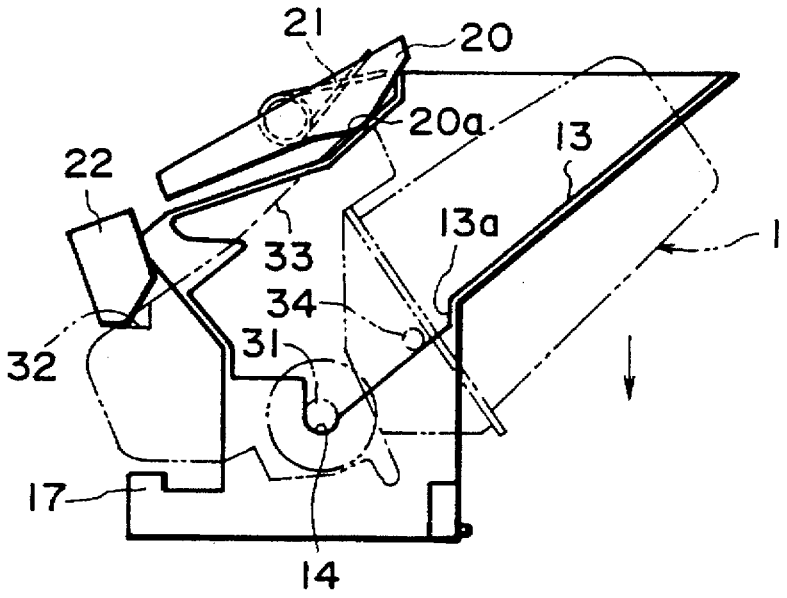
FIG. 11 is an explanatory view of the operation for loading or unloading the process cartridge into or out of the image forming apparatus.

Since the operation for loading or unloading the process cartridge 1 into or out of the apparatus main assembly 100 is approximately the same as that of the first embodiment, only essential points are explained. The process cartridge 1 is pushed in by the operator, as is shown in FIG. 8, while its second protrusive section 31 and third protrusive section 34 are pressed onto the second guide surface 13 of the guide member 10 by the pressing member 20. After the second protrusive section 31 moves beyond the step section 13*a* of the second guide surface 13 and the process cartridge 1 slightly rotated in the counterclockwise direction in FIG. 9, as is show in FIG. 9, the process cartridge 1 is further pushed in. Then, as is shown in FIG. 10, the protrusive section 34 also moves beyond the step section 13*a* of the second guide surface 13, and finally, the upper surface of the process cartridge 1 comes in contact with the stopper member 22. As the operator lets go of the cartridge in this state, the second protrusive section 31 is dropped into the drum shaft bearing section 14 of the guide member 10, as is shown in FIG. 11, and the positioning groove 32 of the process cartridge 1 engages with the stopper member 22, whereby the process cartridge 1 is properly positioned in its loading location within the apparatus main assembly 100 while it remains under the pressure from the pressing member 22.

Figure 12:
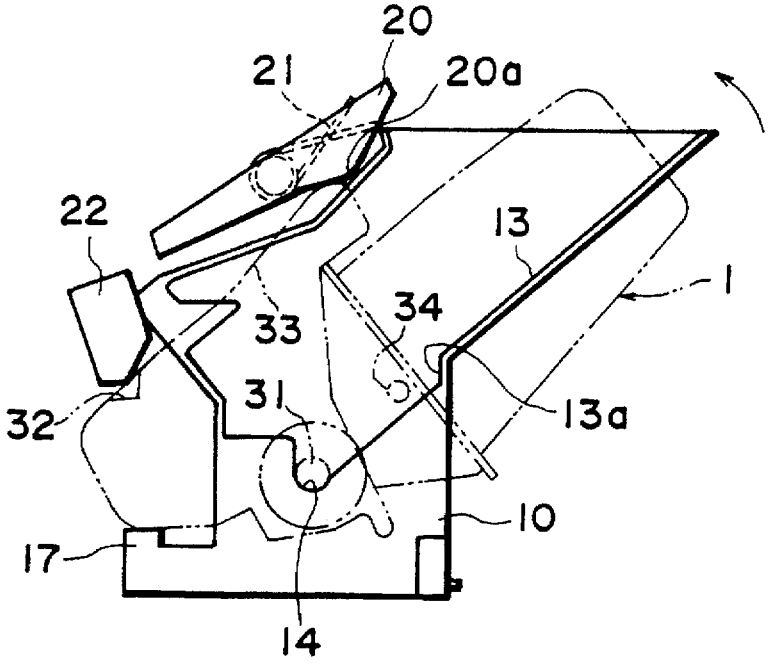
FIG. 12 is an explanatory view of the operation for loading or unloading the process cartridge into or out of the image forming apparatus.
Figure 13:
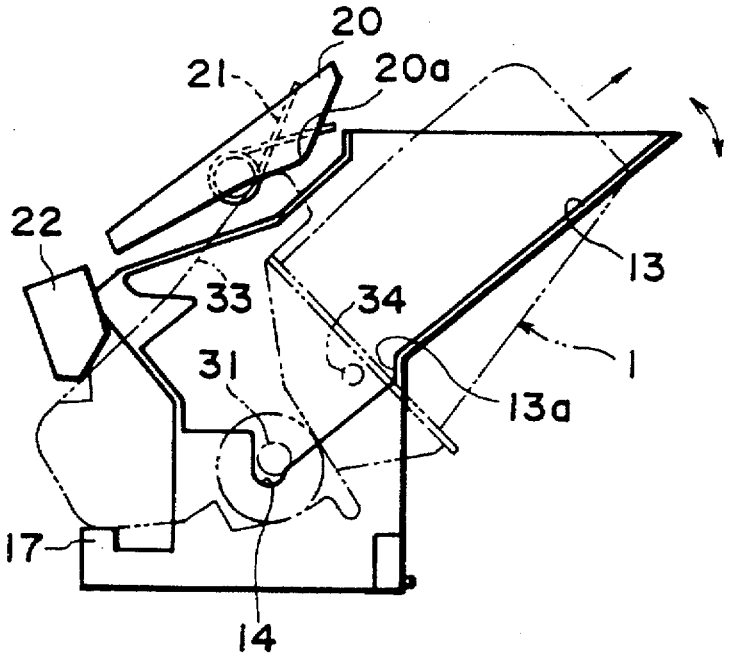
FIG. 13 is an explanatory view of the operation for loading or unloading the process cartridge into or out of the image forming apparatus.

When the process cartridge 1 is to be removed from the apparatus main assembly 100, the exposed upper section of the process cartridge 1 is rotated slightly upward by the operator, as is shown in FIG. 12, whereby the lower section of the process cartridge 1 comes in contact with the support section 17 of the guide member 10. Then, the process cartridge 1 is further rotated in a manner so as to be lifted to the point shown in FIG. 13, using this support section 17 as the fulcrum, whereby this process cartridge 1 can be easily pulled out, diagonally upward, along the guide member 10.

As was stated above, it also becomes possible in this embodiment to load or unload the process cartridge 1, with at least the same effectiveness as the first preferred embodiment. Further, since, specifically in this case, the size and the number of protrusive sections of the process cartridge 1 and the guide member 10 are made so as to be as small as possible, the hindrance by the protrusive sections can be suppressed to a minimum when the process cartridge 1 is loaded or unloaded, whereby the loading/unloading operation becomes substantially easier. Also in this case, since the first protrusive section 30, such as that in the first embodiment, does not need to be provided on the process cartridge 1, the area where the linking mechanism for opening or closing the drum shutter is provided can be made wider on the process cartridge 1, which affords increased freedom in designing the process cartridge 1.

Figure 14:
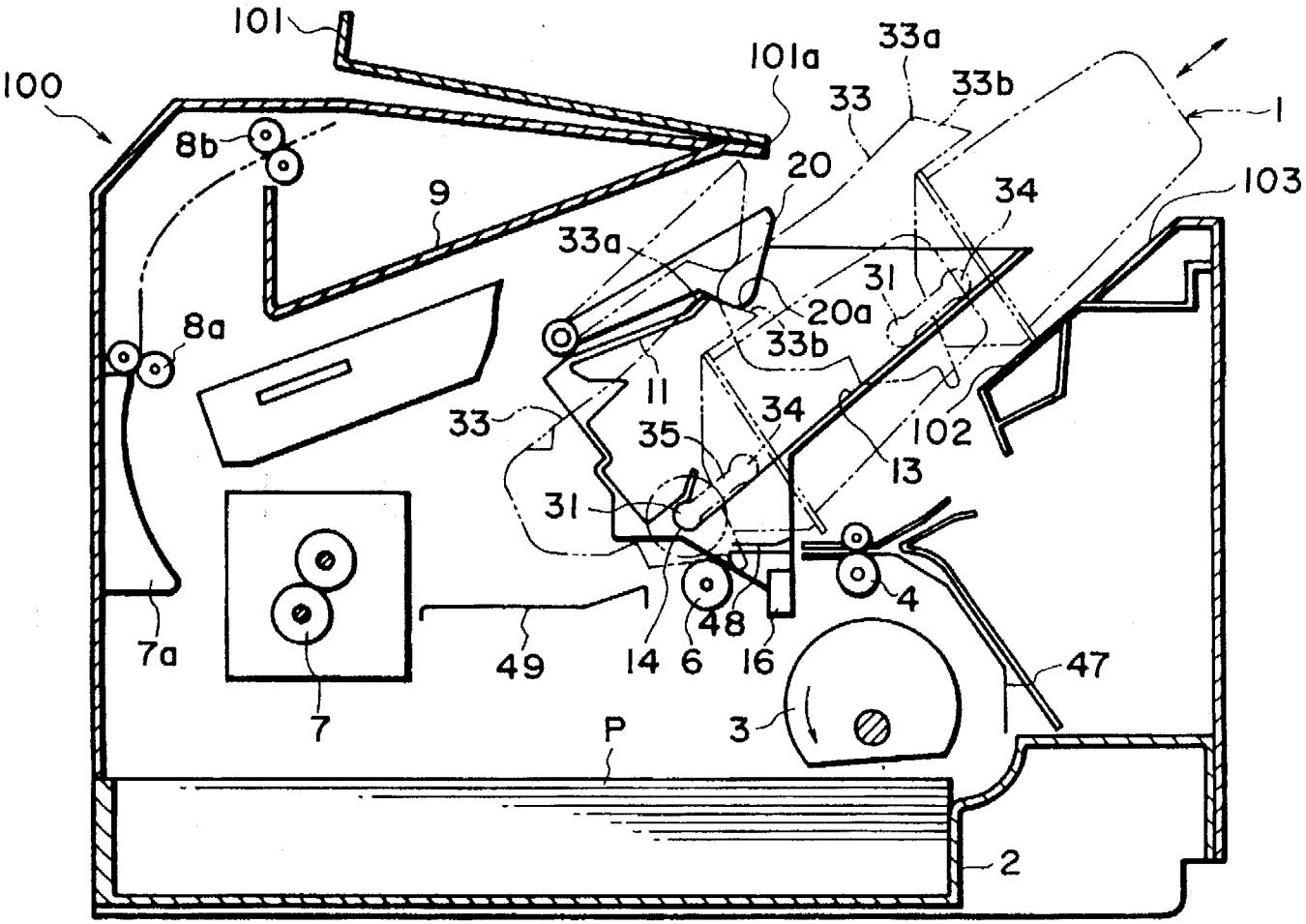
FIG. 14 is a sectional side view of an image forming apparatus in accordance with a preferred embodiment of the present invention.

Next, the third preferred embodiment in accordance with the present invention is explained, referring to FIG. 14. Incidentally, components with the same functions as those in the first and the second embodiments are assigned the same reference numerals in order to make use of their previous explanations.

Now then, in this preferred embodiment, the process cartridge 1 is properly positioned in its loading location within the apparatus main assembly 100 just by being inserted in the diagonal direction along the guide member 10 of the loading/unloading mechanism, and a dropping movement as explained in the first preferred embodiment is not needed.

In other words, the process cartridge 1 is inserted into the apparatus main assembly 100 following the second guide surface 13 (this is not the step section 13*a* explained in the second preferred embodiment) while its second protrusive section 31 and protrusive section 34 (as is evident from the figure, these are connected by reinforcement member 35) are pressed onto the second guide surface 13 of the guide member 10 by the pressing member 20. Then, as the second protrusive section 31 comes close to the drum shaft bearing section 14 of the guide member 10, the pressing member 20 moves over and beyond bend section 33*a* which includes an upward inclined surface contiguous with a flat surface, of, the upper pressure bearing surface or projection 33 and presses the downward inclined surface 33*b*, which declines rightward. Finally, the second protrusive section 31 of the process cartridge 1 is positioned in the drum shaft bearing section 14, whereby the process cartridge 1 is properly positioned in its loading location within the apparatus main assembly 100, while remaining under pressure.

At this point, as the pressing member 20 moves over and beyond the bend section 33*a* of the upper pressure bearing section 33 of the process cartridge 1 and presses the downward surface 33*b*, the pressure imparted on the process cartridge 1 by the pressing member 20 changes its pressing direction, thereby functioning to force this process cartridge 1 inward of the apparatus main assembly 100. Therefore, not only the operation for inserting the process cartridge 1 becomes easier but also the operator can sense, through a clicking feel obtained at this time, that the positioning of the process cartridge 1 in its loading location within the apparatus main assembly 100 is about to be completed.

Now then, in the event a positioning method of inserting the process cartridge 1 in a straight line is used, there is a fear that the teeth of the driven gear of the process cartridge 1 and those of the driving gear of the apparatus main assembly 100 side will crash into each other and the gear tooth surfaces may be damaged, but according to this preferred embodiment, since the pressure from the pressing member 20 works as a resistance for halving the thrust of inserting the process cartridge 1 into the apparatus main assembly 100, gear tooth surface damage can be prevented. Incidentally, when the process cartridge 1 is in its proper loading location, the driving gear and the driven gear are positioned in such a manner that the driving force is transferred in the direction approximately perpendicular to the inserting direction of process cartridge 1.

As was described above, at least the same effectiveness can be also accomplished in this preferred embodiment as the first preferred embodiment. Further, in this preferred embodiment, since the process cartridge 1 need only be moved in a straight line specifically when the process cartridge 1 is to be loaded, and the guide surface of the guide member 10 comprises only the guide surface 13, in other words, because its structure is simple, the operation for loading or unloading the process cartridge 1 becomes far easier, which affords additional operational efficiency in loading and unloading.

In the above first to third preferred embodiments, the protrusive sections 30, 31 and 34 are provided on both side of the process cartridge 1, and these are pressed onto the guide surfaces 12 and 13 of the guide member 10, but certain sections of the external surface of the process cartridge 1 may be used to be pressed onto the guide surfaces. Also, the loading/unloading direction of the process cartridge 1 may be the same as that of the drum shaft of the photosensitive drum 1*a*. Further, the pressing member 22 may comprise components which directly press the protrusive sections 30, 31 and 34 of the process cartridge 1.

Figure 15:
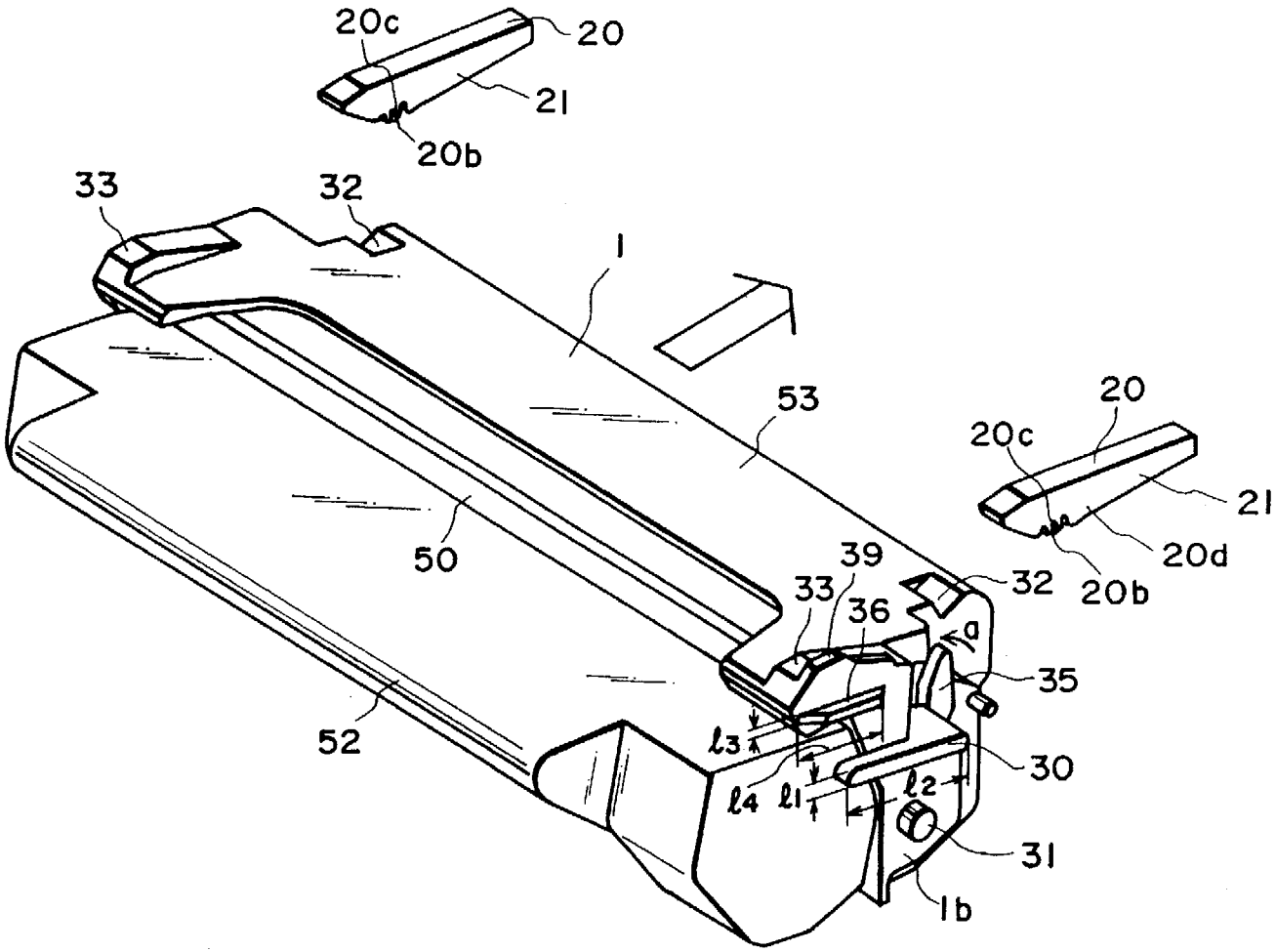
FIG. 15 is a perspective view of a process cartridge in accordance with a preferred embodiment of the present invention.
Figure 16:
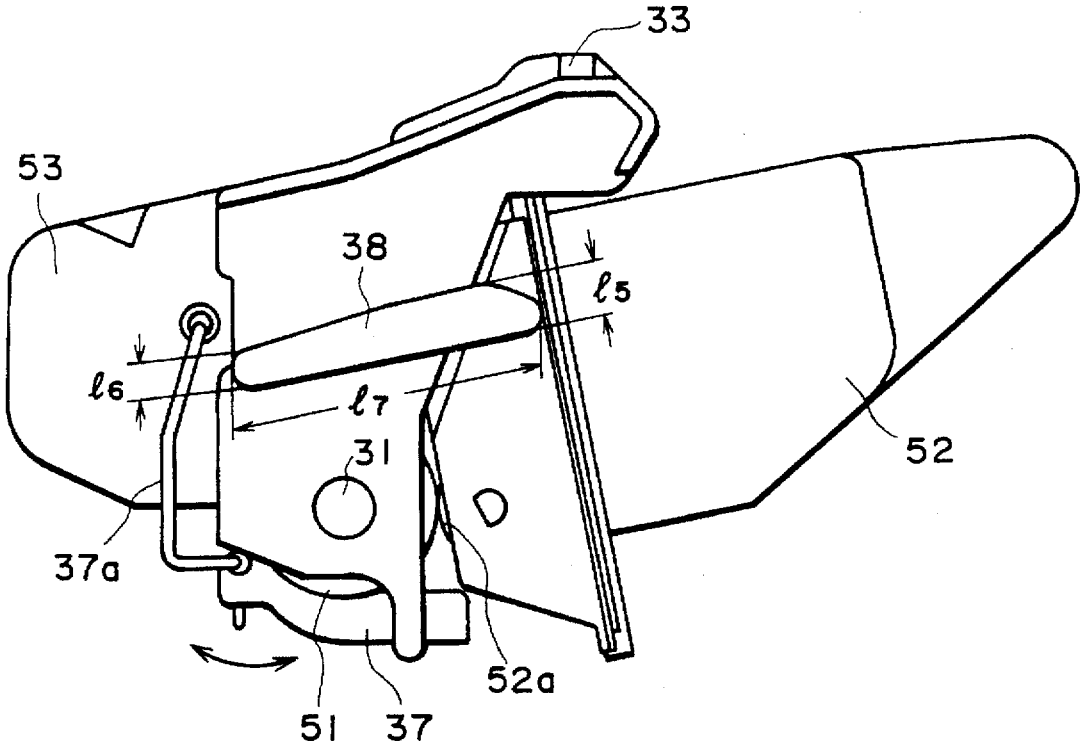
FIG. 16 is a side view of the process cartridge shown in FIG. 15.
Figure 17:
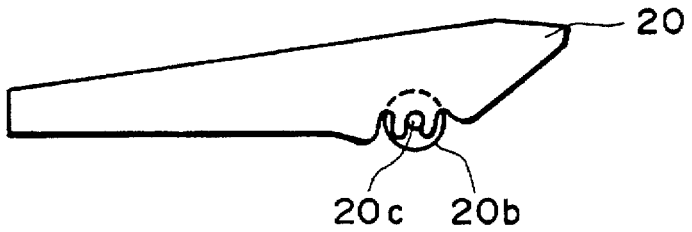
FIG. 17 is a side view of a pressing member.
Figure 18:
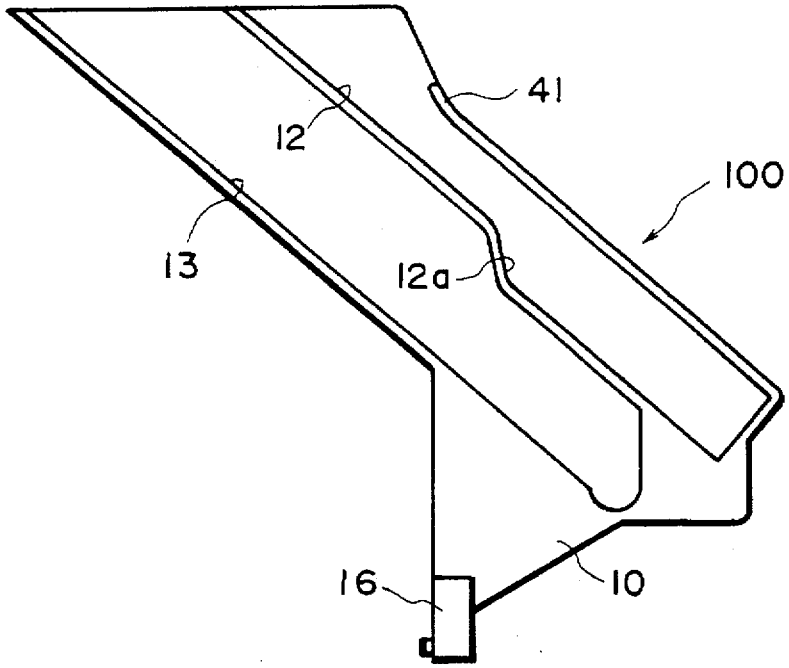
FIG. 18 is a side view of the guide member on the side of the apparatus main assembly.

Next, the fourth preferred embodiment in accordance with the present invention is explained, referring to FIG. 15 to FIG. 18. Incidentally, FIG. 15 is a perspective view of the process cartridge and the pressing members on the apparatus main assembly side, in the preferred embodiment in accordance with the present invention; FIG. 16 is a left side view of the process cartridge shown in FIG. 15; FIG. 17 is a side view of the pressing member; and FIG. 18 is a side view of the guide member on the apparatus main assembly side.

In this preferred embodiment, a rib 36 is provided on the right side surface of the process cartridge 1, in addition to the protrusive sections in the above mentioned first preferred embodiment. This rib 36 is provided upward of the above mentioned first protrusive section 30, approximately parallel to this. Further, the shape of the guide rib 38 provided on the left side surface is made different from the shape of the protrusive section 30 provided on the right side surface, and the shape of the guide rib 38 is made to be wider than the shape of the first protrusive section 30. Now then, according to this preferred embodiment, the locus of the process cartridge 1 is substantially more regulated by the above mentioned rib 36 when it is inserted into the apparatus main assembly. Moreover, the process cartridge 1 is regulated by this rib 36 so as not to rotate in the counterclockwise direction when the cam 35 on the process cartridge 1 side comes in contact with the cam surface 11 of the guide member 10 on the apparatus main assembly side for opening or closing the drum shutter while the process cartridge 1 is being inserted. The cam 35 rotates in the counterclockwise direction (arrow direction in FIG. 15) by coming in contact with the cam surface 11, and opens the drum shutter 37 supported by the arm 37*a* (FIG. 16). On the other hand, the guide rib 38 regulates the process cartridge 1 so as not to be rotated in the counterclockwise direction by the rib 41 provided on the guide member 10 on the apparatus main assembly. With the above arrangement, according to this preferred embodiment, the locus of the process cartridge 1 is rigidly regulated while the process cartridge 1 is loaded into or unloaded from the apparatus main assembly, whereby the opening or closing of the drum shutter 37 is made reliable. Also, even if the opening of the main assembly cover 101 is small, or the process cartridge 1 is rotated a large angle while it is being pulled out, the process cartridge 1 can be smoothly unloaded.

As has been stated above, in this preferred embodiment, the cartridge frame structures 1*b* are provided on both sides, in the axial direction of the photosensitive drum 1*a*, of the process cartridge 1, and the first protrusive section 30, which protrudes outward from the frame structure 1*b*, is provided on one of the cartridge frame structure 1*b*, and the guide rib 38, which protrudes outward from the frame structure 1*b*, is provided on the other of the cartridge frame structure 1*b*. In addition, the rib 36, which also protrudes outward, is provided upward of the above mentioned first protrusive section 30. The above mentioned first protrusive section 30 and the guide rib 38 are provided in a manner so as to extend approximately from the cleaning means 53 location to the developing device location, and is long and narrow. The rib 36 is provided in a manner so as to extend approximately from the location of the above mentioned photosensitive drum 1*a* to the above mentioned cleaning means 53 location, and is also long and narrow. The above mentioned rib 36 is arranged to be approximately parallel to the above mentioned first protrusive section 30, and the above mentioned rib 36 is located towards the developing device compared to the above mentioned first protrusive section 30. 0n one side of the frame structure 1*b* on which these first protrusive section 30 and rib 36 are provided, the cam 35 is provided, which comes in contact with the cam section 11 formed on the apparatus main assembly 100 side and opens the drum shutter 37 which covers the transfer region of the photosensitive drum 1*a* when the process cartridge 1 is loaded into the apparatus main assembly 100.

Next, examples of the dimensions of the above mentioned first protrusive section 30, rib 36, and guide rib 38 are presented.

First, the first protrusive section 30 is approximately 5 mm in width ($l_1$) and 50 mm in length ($l_2$). The rib 36 is approximately 2 mm in width ($l_3$) and 35 mm in length ($l_4$). The guide rib 38 is approximately 8.5 mm at the widest point ($l_5$) and 5 mm at the narrowest point ($l_6$), and 50 mm in length ($l_7$). As for the height of protrusions from the frame structure 1*b*, it is approximately 5 mm for the first protrusive section 30, 3 mm for the rib 36, and 8 mm for the guide rib 8.

Next, the pressing member 20 of this preferred embodiment is explained, referring to FIG. 17.

In this preferred embodiment, a roller 20*b* is provided on the pressing member 20 provided on the apparatus main assembly side, at its sliding contact point with the process cartridge 1. This roller 20*b* can rotate around the shaft 20*c*. According to this preferred embodiment, the sliding resistance between the pressing member 20 and the process cartridge 1 becomes much smaller, improving the operational efficiency in loading or unloading the process cartridge 1.

Also, the side surface 20*d* of the pressing member 20 may be used to regulate the side surface of the rib 39 which protrudes from the upper surface of the process cartridge 1, at its side edge, so that the process cartridge 1 is impelled to the right relative to the inserting direction of the process cartridge 1 when the process cartridge 1 is inserted, whereby the process cartridge 1 is properly positioned in its width direction during its insertion. Also, if the pressure bearing section 33 of the process cartridge 1 is formed as a rib instead of a surface, its contact surface with the pressing member 20 becomes smaller, and therefore, the sliding resistance becomes smaller, in addition to the above improvement.

Incidentally, 50 is an exposure opening, 51 a photosensitive drum, 52 a developing means (52*a* is a developing sleeve), and 53 is a cleaning means.

Next, the fifth preferred embodiment in accordance with the present invention is explained, referring to FIG. 19 to FIG. 22.

As is evident from the foregoing explanation, according to each of the above mentioned preferred embodiments, when the process cartridge is to be loaded into or unloaded from the apparatus main assembly, this process cartridge is moved following the guide surface of the guide member while it is being pressed onto this guide surface of the guide member by the pressing member. Therefore, the process cartridge is easily and reliably loaded or unloaded without losing its attitude, even though the size of the contact between the process cartridge and the guide member is small. Also, this process cartridge can be loaded or unloaded just by pressing the process cartridge onto the guide surface of the guide member. Therefore, it is not necessary for the process cartridge to be aimed at a certain location within the apparatus main assembly, as was in the past, when the process cartridge is to be loaded, whereby the opening for loading or unloading the process cartridge becomes easier and can be performed more reliably. In addition, since the loading or unloading operation of the process cartridge is not interlocked with the movement of the main assembly cover when the process cartridge is loaded or unloaded, not only is the load not imparted to the main assembly cover, but it is also not necessary to provide the protrusions and the like on the under side of the main assembly cover.

Figure 19:
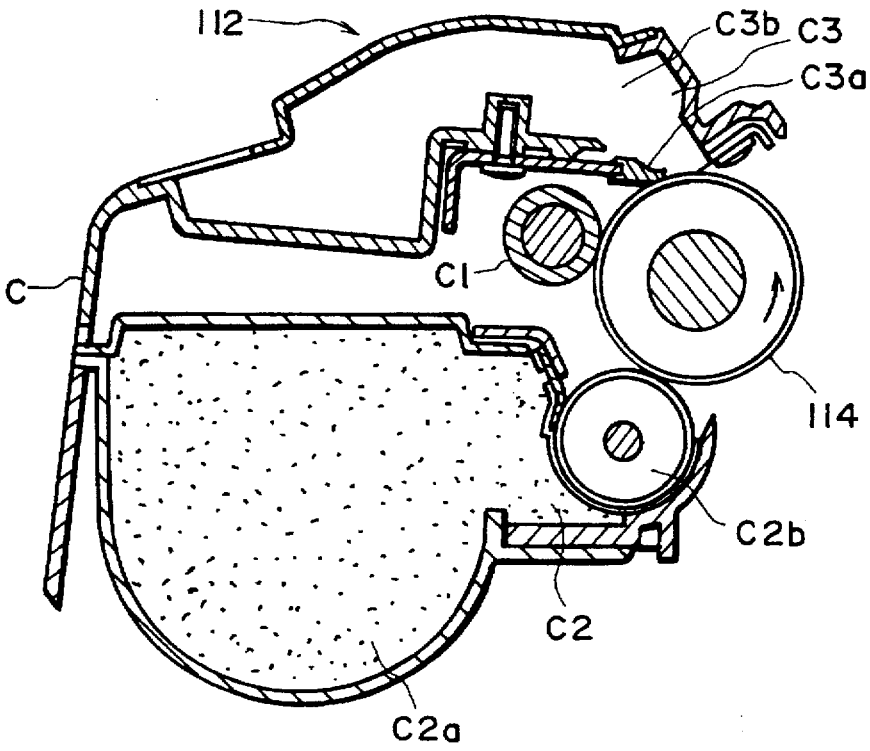
FIG. 19 is a sectional side view of a process cartridge in accordance with a preferred embodiment of the present invention.
Figure 20:
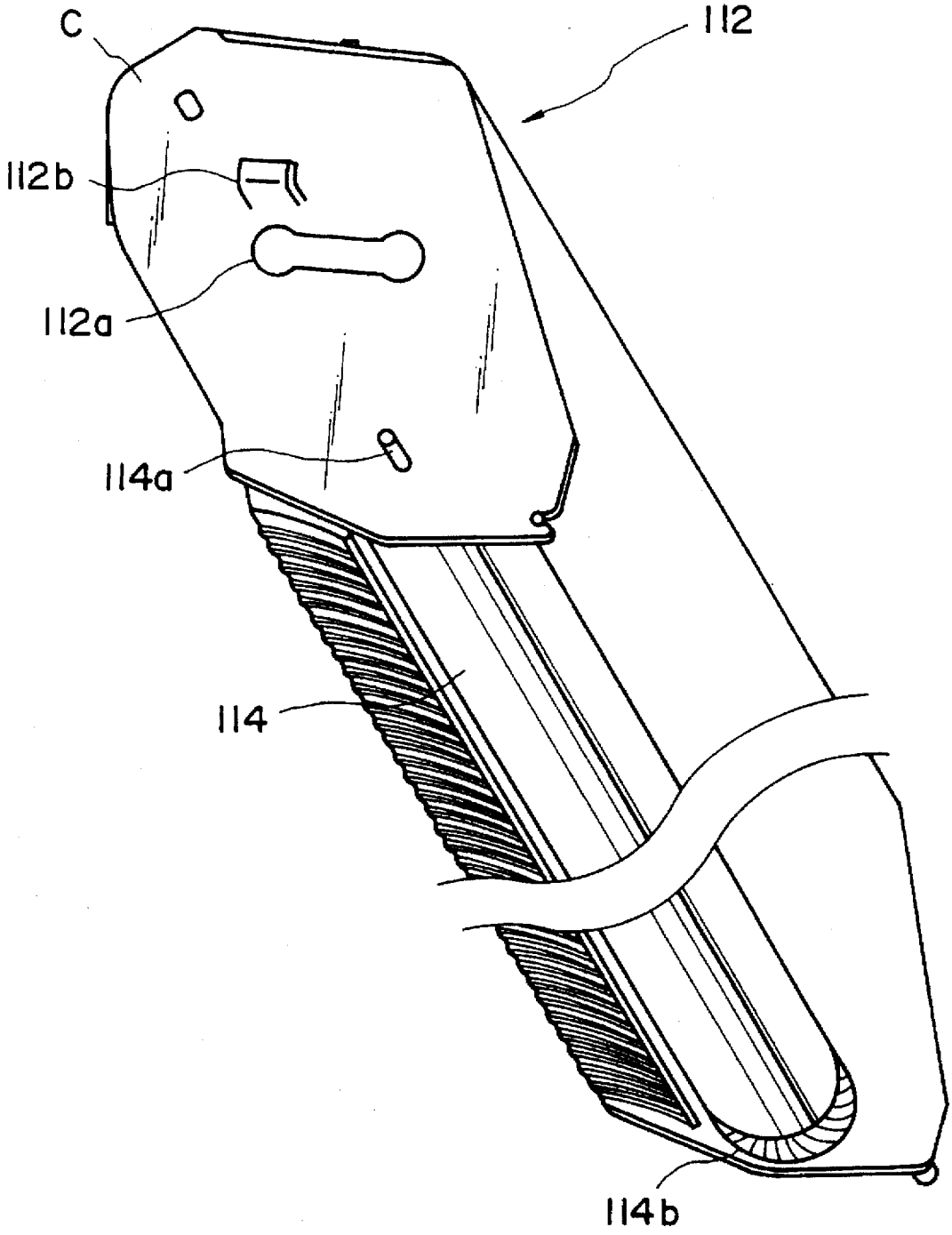
FIG. 20 is a perspective view of the process cartridge shown in FIG. 19.

To begin with, the structure of the process cartridge 112 of this preferred embodiment is explained, referring to FIG. 19 and FIG. 20. FIG. 19 is a sectional view showing the sectional structure of the process cartridge 112, and FIG. 20 is a perspective view of this process cartridge 112.

In the casing C of the process cartridge 112, a photosensitive drum 114 is supported so as to rotate freely, as is shown in detail in FIG. 19, and around the photosensitive drum 114, a primary charging device (charging roller) C1 which charges the surface of the photosensitive drum 114 to a uniform potential, a developing device C2 (toner storage section C2*a* and developing sleeve C2*b*) which stores toner and develops an electrostatic latent image formed on the photosensitive drum 114 into a toner image, and a cleaning device C3 (cleaning blade C3*a* and waste toner storage C3*b*) which removes the toner residue on the photosensitive drum 114, are provided in an orderly manner. At the end section of the above mentioned photosensitive drum 114, a helix gear 114*b* (FIG. 21) is provided, which engages with a gear on the image forming apparatus side and transfer the driving force from the driving means (not illustrated) when the process cartridge 112 is loaded in the image forming apparatus main assembly 100. As this helix gear 114*b* engages with the gear on the image forming apparatus side and rotates with it, the photosensitive drum 114 is impelled toward the opposite side (in the thrust direction) to the helical gear, and at the same time, the process cartridge 112 is also impelled in the like direction, whereby this process cartridge 112 is accurately positioned in the thrust direction.

Figure 21:
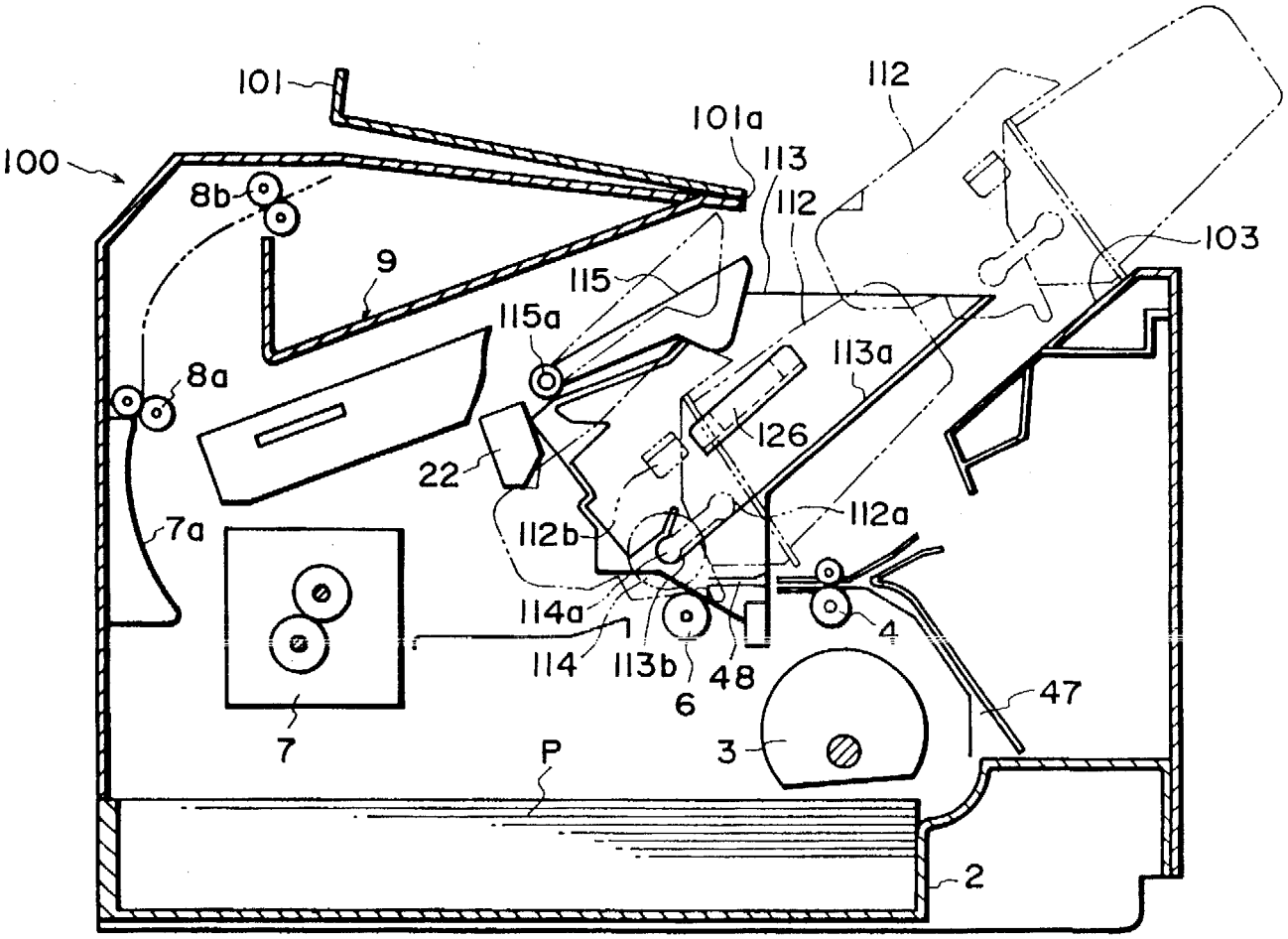
FIG. 21 is a sectional side view of an image forming apparatus in accordance with a preferred embodiment of the present invention.

Next, the structure of the image forming apparatus which can accept the process cartridge 1 is briefly explained, referring to FIG. 21.

Incidentally, the explanation is given using a copying apparatus as an example which represents the image forming apparatus.

FIG. 21 is a longitudinal, sectional view showing the structure of the copying apparatus (image forming apparatus) in accordance with an embodiment of the present invention. In the apparatus main assembly 100, the transfer charging device 6 is affixed facing the photosensitive drum (image bearing member) 114 supported in the process cartridge 112 loaded in the apparatus main assembly 100. Below this transfer charging device 6 in the apparatus main assembly 100, there is a cassette 2 which is attached in a manner so as to be freely mounted or dismounted, and stores the transfer material P which is fed between the transfer charging device 6 and the photosensitive drum 114 and on which the toner image is transferred. Adjacent to this cassette 2, there is a feed roller 3 which is provided to feed sequentially the transfer materials P one by one in an orderly manner, and upward of this feed roller 3, there is a resist roller (conveying means) 4 which is provided to feed the transfer material P in synchronization with the rotation of the photosensitive drum 114. The transfer material P which receives the toner image by transfer is delivered by the roller 8*a* and the roller 8*b* into the delivery tray 9 after the toner image is fixed by the fixing device 7.

Figure 22:
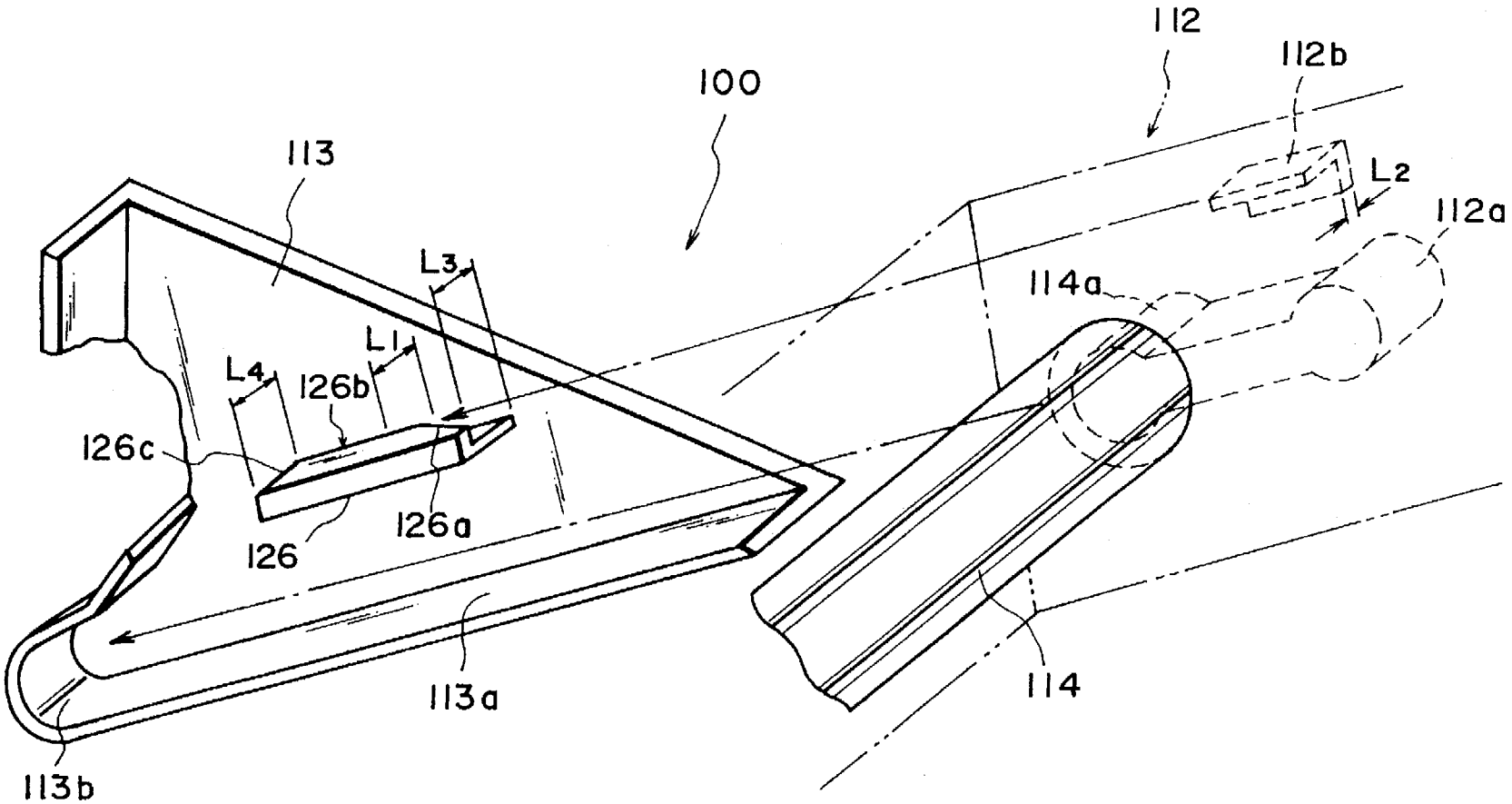
FIG. 22 is a perspective view showing the engagement relation between the thrust rail member and the thrust guide of an image forming apparatus in accordance with a preferred embodiment of the present invention.

Next, a thrust guide section (second engaged member) 112*b* which is provided, as a means for regulating the sliding passage, on the casing C of the above mentioned process cartridge 112, and a thrust rail member (second engaged member) 126 which is provided as a loading means, are explained in regard to their structures, referring to FIG. 22. In FIG. 22, the process cartridge 112 which is slid in the direction indicated by an arrow mark to be loaded into the apparatus main assembly 100, the photosensitive drum 114 which is supported within this process cartridge 112, the rotative shaft 114*a* which protrudes further backward from the side wall of the back side of the process cartridge 112, and the protrusive section (first engaging member) 112*a* which protrudes backward in the like manner are outlined by the two-dot chain lines, and the guide member 113 which is provided on the apparatus main assembly 100 in a manner so as to face the side wall section of the backside of this process cartridge 112 is outlined by the solid line.

In the figure, the thrust guide section 112*b* has an L-shaped sectional profile, and is attached on both side walls of the process cartridge 1, one on each side wall (in the figure, only the one attached to the side wall section on the back side is illustrated). On the other side, the guide member 113 (only the one on the back side is illustrated) is provided with a thrust rail member 126, and this thrust rail member 126 which protrudes toward this side is attached to be engaged with the above mentioned thrust guide section 112*b*.

Also, this thrust rail member 126 is provided with an entry section 126*a*, positioning section 126*b*, and end section 126*c*, which displace the thrust guide section 112*b* in the thrust direction as the thrust guide section 112*b* moves along during the insertion of the process cartridge 112, and their shapes are as follows. That is, the gap L1 between the positioning section 126*b* and the guide member 113 is set up to be wider than the width L2 of the thrust guide section 112*b* of the process cartridge 112, and the width L3 of the entry section 126*a* and the width L4 of the end section 126*c* are set up to be equal. Also, these widths L3 and L4 are formed so as to be wider than the width L2 of the thrust guide section 112*b*, and the entry section 126*a* is tapered.

Next, the operation of the above mentioned preferred embodiment is explained.

As is outlined by the two-dot chain lines in FIG. 21 and FIG. 22, when the protrusive section 112*a* of the process cartridge 112 is placed on the rail section 113*a* of the apparatus main assembly 100 side, this process cartridge 112 slides downward following the rail section 113*a*. Wherever the process cartridge 112 is in the thrust direction, the thrust guide section 112*b* comes in contact with the tapered surface of the entry section 126*a* while the process cartridge 112 is slid. As the process cartridge 112 slides further in this state due to its own weight, in other words, as the thrust guide section 112*b* moves following the above mentioned tapered surface, the process cartridge 112 is displaced in the thrust direction. Then, the thrust guide section 112*b* moves following the positioning section 126*b*, and at this time, the position of the process cartridge 112 in the thrust direction is regulated. As the process cartridge 112 slides further following the rail section 113, the thrust guide section 112*b* is disengaged from the thrust rail section 126, and finally, the rotative shaft 114*a* is fitted into the bearing section 113*b*, whereby the position of this rotative shaft 114*a* is regulated. At this time, this process cartridge 112 is properly positioned also in the sliding direction by the positioning members 115 and 116. When this rotative shaft 114*a* is in such a predetermined location, the gear (not illustrated) provided within the copying apparatus engages with the helix gear 114*b* which is coaxial with the rotative shaft 114*a*. As the gear provided on the above mentioned copying apparatus side rotates during image formation, the photosensitive drum 114 is impelled toward the back of the casing C of the process cartridge 112, whereby the position of this process cartridge is regulated in the thrust direction.

With the above arrangement, the position of the process cartridge 112 is determined based on the engagement between the thrust guide section 112*b* and the thrust rail member 126.

Moreover, such positioning is carried out by the sliding of the thrust guide section 112*b* following the tapered surface of the entry section 126*a* of the thrust rail member 126 due to the self weight of the process cartridge 112, and when this sliding ends, the positioning of the process cartridge 112 in the thrust direction is completed.

At the final stage, when the loading of the process cartridge 112 is completed, the thrust rail member 126 and the thrust guide section 112*b* are not in the engaged state, and the positioning in the thrust direction is carried out by the engagement between the helix gear 114*b* of the photosensitive drum 114 and the gear on the copying apparatus side. Therefore, a force such as is constantly imparted on the process cartridge 112 in the case of the prior technology is not present, and it is not necessary to increase the rigidity of the process cartridge 112 more than usual.

Moreover, since such simultaneous bi-directional positioning of the process cartridge 112 as that in the case of the prior technology is not performed, and the positioning in the thrust direction is carried out when the photosensitive drum 114 rotates, the vertical positioning by the positioning members 115 and 116 can be accurately carried out.

Figure 23:
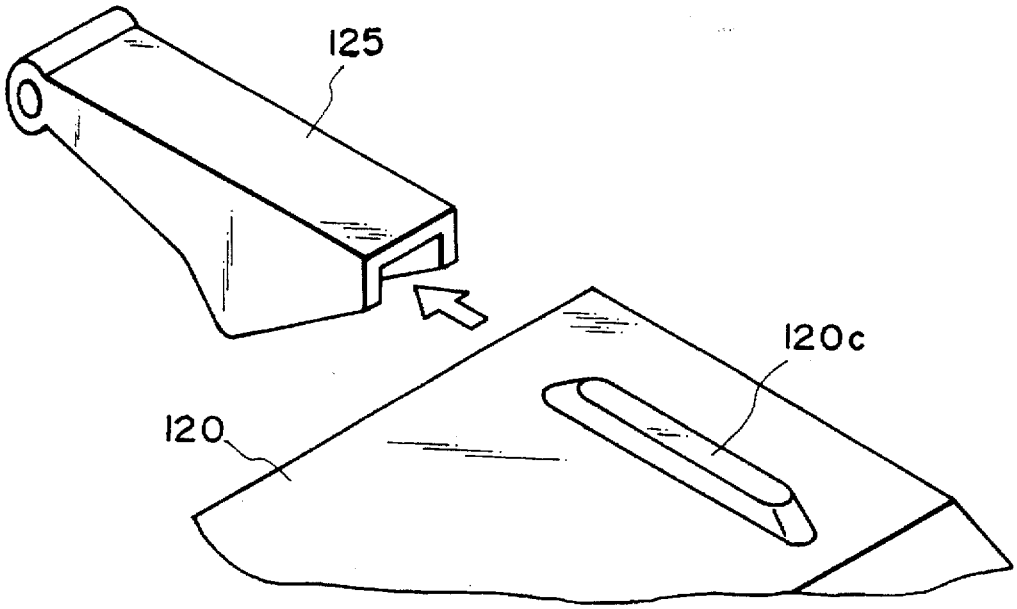
FIG. 23 is a perspective view of the loading/unloading mechanism of an image forming apparatus in accordance with a preferred embodiment of the present invention.
Figure 24:
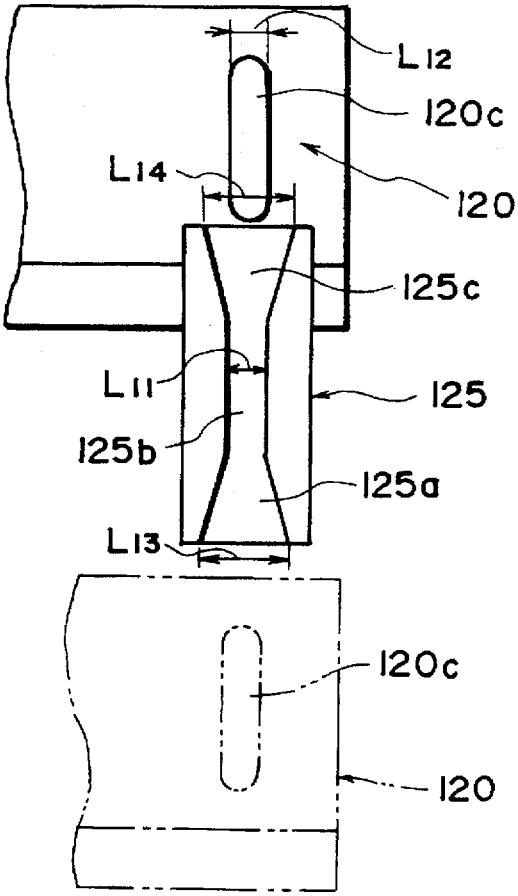
FIG. 24 is a plan view showing the engagement relation between the positioning rail member and the protrusive section, in accordance with a preferred embodiment of the present invention.
Figure 25A:
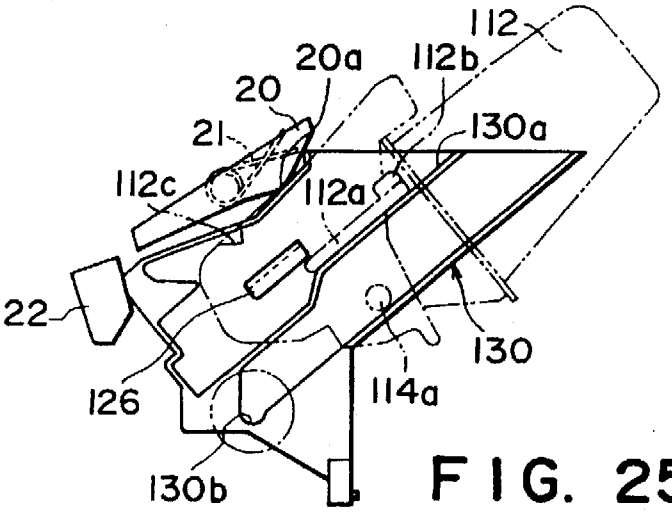
FIGS. 25A, 25B, 25C and 25D are explanatory views showing the operation for loading or unloading the process cartridge into or out of the image forming apparatus.
Figure 25B:
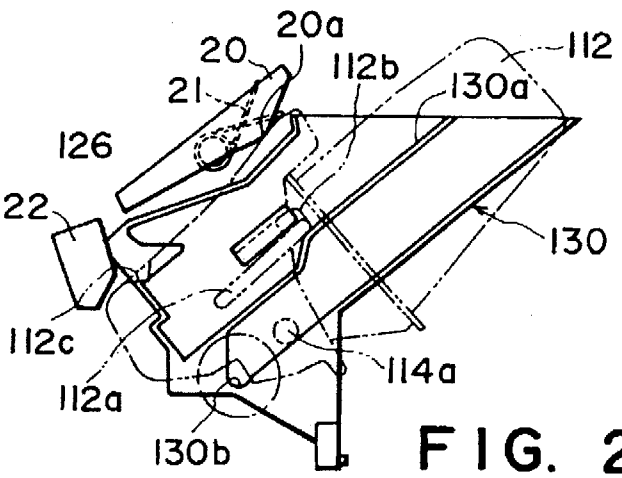
Figure 25C:
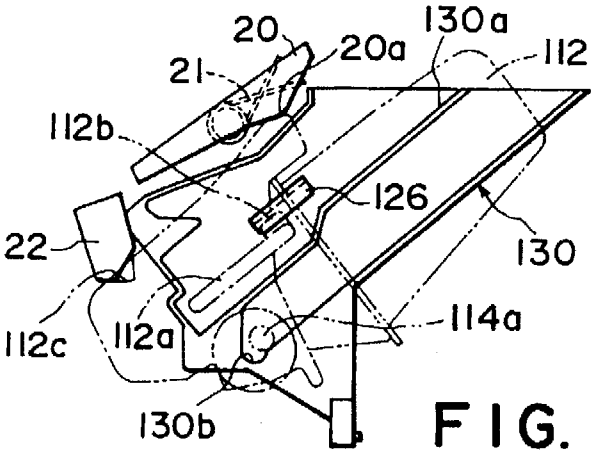
Figure 25D:
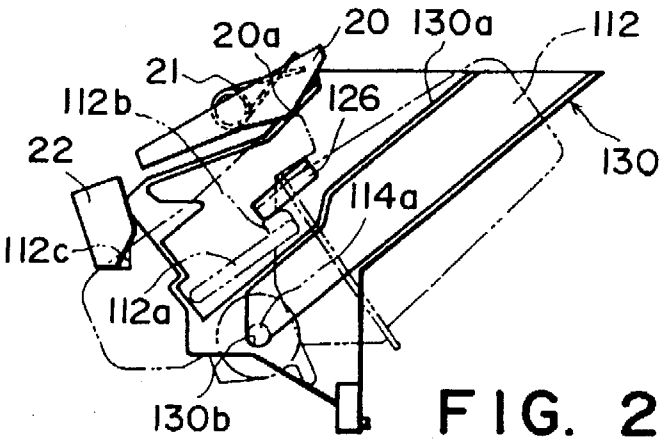

Next, the sixth preferred embodiment of the present invention is explained, referring to FIG. 23 and FIG. 24. FIG. 23 is a perspective view showing the state of engagement between the process cartridge 120 and the positioning rail member 125, and FIG. 24 is a plan view showing the loading process of the process cartridge 120.

On the upper wall section of the process cartridge 120, an protrusive section (second engaging member) 120*c* is formed in the sliding direction of the process cartridge 120, and a positioning rail member (second engaged member) 125 is provided on the apparatus main assembly side, which has a U-shaped sectional profile in order to be engaged with this protrusive section 120*c*. This positioning rail member 125 is supported so as to rotate freely, and is also pressed by a pressuring means (not illustrated) which presses the process cartridge 120 downward. As shown in FIG. 24, the positioning of the process cartridge 120 in its thrust direction is regulated by the engagement between the process cartridge 120 and the positioning rail member 125 during its sliding movement, but this engagement is not present at the time when the loading is completed. Further, the protrusions formed on both side wall sections of the process cartridge 120 are placed on the rail sections of the apparatus main assembly side, thereby sliding this process cartridge 120. Such a configuration is the same as that in the above mentioned preferred embodiments.

On the positioning rail member 125, an entry section 125*a*, a positioning section 125*b*, and the end section 125*c* are formed in this order, and the width L11 of the positioning section 125*b* is set up to be slightly wider than the width L12 of the protrusive section 120*c*. Both the width L13 of the entry section 125*a* and the width L14 of the end section 125*c* are set up to be wider than the width L12.

With the above arrangement, the positioning of the process cartridge 120 in the thrust direction is carried out based on the engagement between the protrusive section 120*c* and the positioning rail member 125.

Such positioning is carried out as the protrusive section 120*c* slides following the tapered surface of the entry section 125*a* of the rail member 125 due to the self weight of the process cartridge 120. When this sliding ends, the positioning of the process cartridge 120 in the thrust direction is completed.

Moreover, at the final stage when the loading of the process cartridge 120 is completed, the positioning rail member 125 and the elongated protrusive section 120*c* are not in the engaged state, and a force in the thrust direction such as is constantly imparted on the process cartridge 120 in the case of the prior technology is not present, whereby it is not necessary to increase the rigidity of the process cartridge 120 more than usual.

Further, since such simultaneous bi-directional pressure as that in the case of the prior technology is not imparted on the process cartridge 120, the vertical positioning by the positioning rail member 125 can be accurately carried out.

Figure 26:
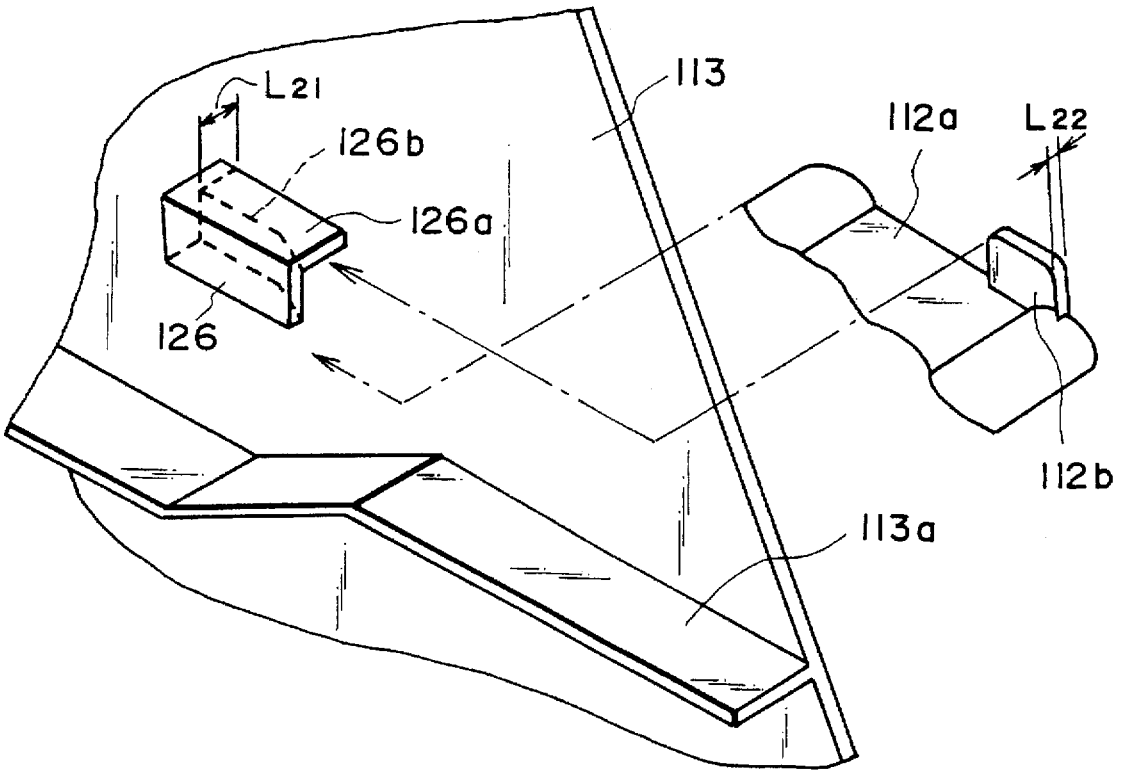
FIG. 26 is a perspective view showing the engagement relation between the thrust rail member and the thrust guide member in accordance with a preferred embodiment of the present invention.

Next, the seventh preferred embodiment in accordance with the present invention is explained, referring to FIG. 25 and FIG. 26.

FIG. 25 shows the structure of the copying apparatus, and the steps for loading the process cartridge 112 into the apparatus main assembly 1, and FIG. 26 is a perspective view showing the state of engagement between the thrust guide section (second engaging member) 112*b* and the thrust rail member (second engaged member) 126. In this preferred embodiment, the sliding passage of the process cartridge 112 is not linear, and the rail section (first engaged member) 130*a* is bent as is shown in the figure.

When the projection (first engaging member) 112*a* of the process cartridge 112 to be loaded into the apparatus main assembly 100 is placed on the rail section 130*a* on the apparatus main assembly 1 side (FIG. 25(*a*)), this process cartridge 112 slides following the rail section 130*a*. Then, during its sliding process, the thrust guide section 112*b* which protrudes from the protrusive section 112*a* (shown in detail in FIG. 26) engages with the thrust rail member 126, whereby the positioning of the process cartridge 112 in the thrust direction is carried out (FIG. 25(*b*)). As the process cartridge 112 linearly slides further, the positioning member 22 is fitted in the concave section 112*c* formed on the upper wall section of the process cartridge 112 (FIG. 25(*c*)). At this time, the engagement between the thrust guide section 112*b* and the thrust rail member 126 has been broken, and the positioning member 20 is pressed upon the upper wall section of the process cartridge 112. Therefore, the process cartridge 112 rotates clockwise around its contact point with the positioning member 22, coming into the state shown in FIG. 25(*d*). The rotative shaft 114*a*, which comes sliding following the rail section formed below the rail section 130*a*, is finally fitted in the bearing section 130*b*, whereby the position of this rotative shaft 114*a* is also regulated.

The above mentioned thrust rail member 126 is provided with the entry section 126*a* which forms the tapered surface, and the positioning section 126*b* which regulates the position of the process cartridge 112 in the thrust direction, and the width L21 of the positioning section 126*b* and the width L22 of the thrust guide section 112*b* have a relation for fitting properly to each other (FIG. 26).

With the above arrangement, the positioning of the process cartridge 112 in the thrust direction is carried out based on the engagement between the thrust guide section 112*b* and the thrust rail member 126.

At the final stage, when the loading of the process cartridge 112 is completed, the thrust rail member 126 and the thrust guide section 112*b* are not in the engaged state, and a force in the thrust direction is not imparted on the process cartridge. Therefore, it is not necessary to increase the rigidity of the process cartridge 112 more than usual, and also, the positioning by the positioning member 20 is accurately carried out.

Figure 27:
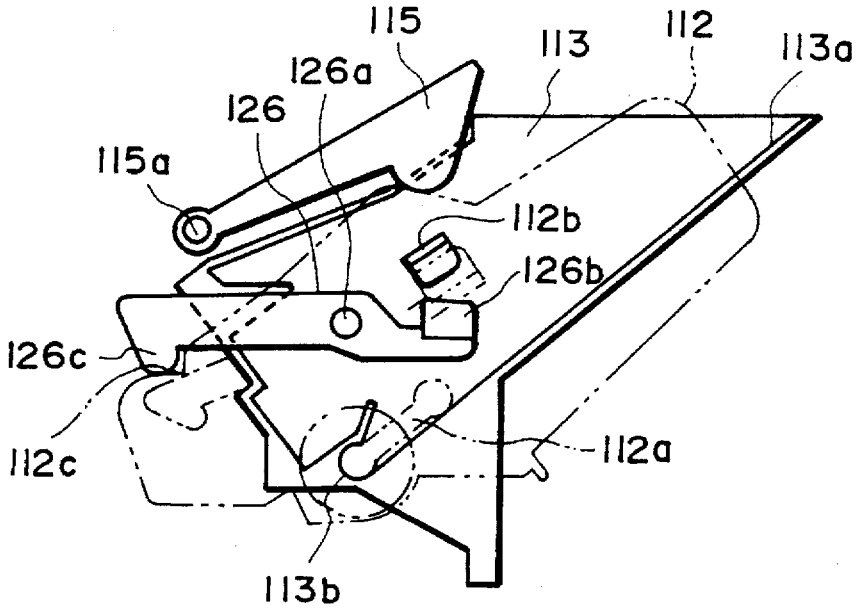
FIG. 27 is a side view of the loading/unloading mechanism in accordance with a preferred embodiment of the present invention.
Figure 28:
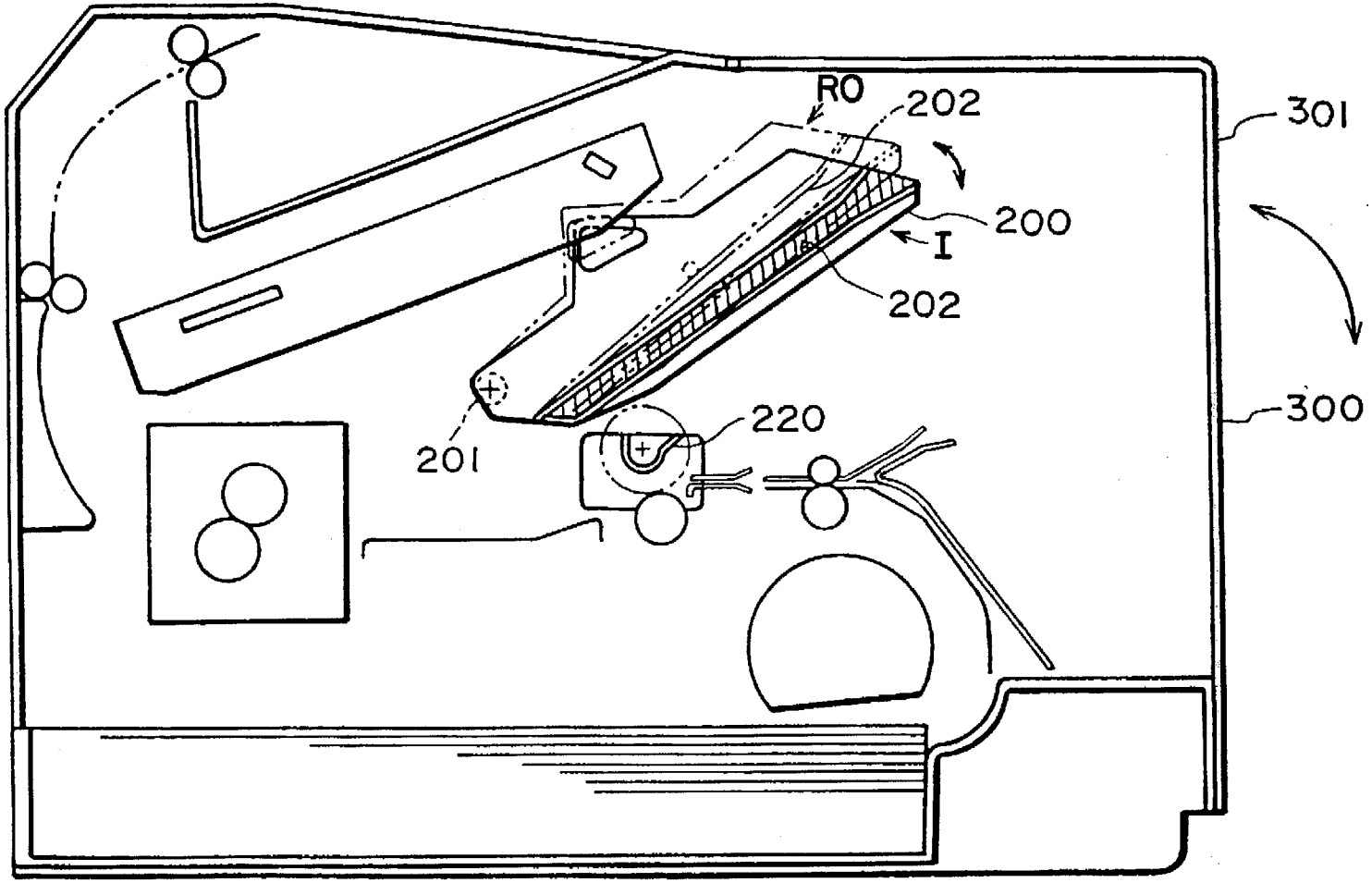
FIG. 28 is a sectional side view of an image forming apparatus for explaining the background technology of the present invention.
Figure 29:
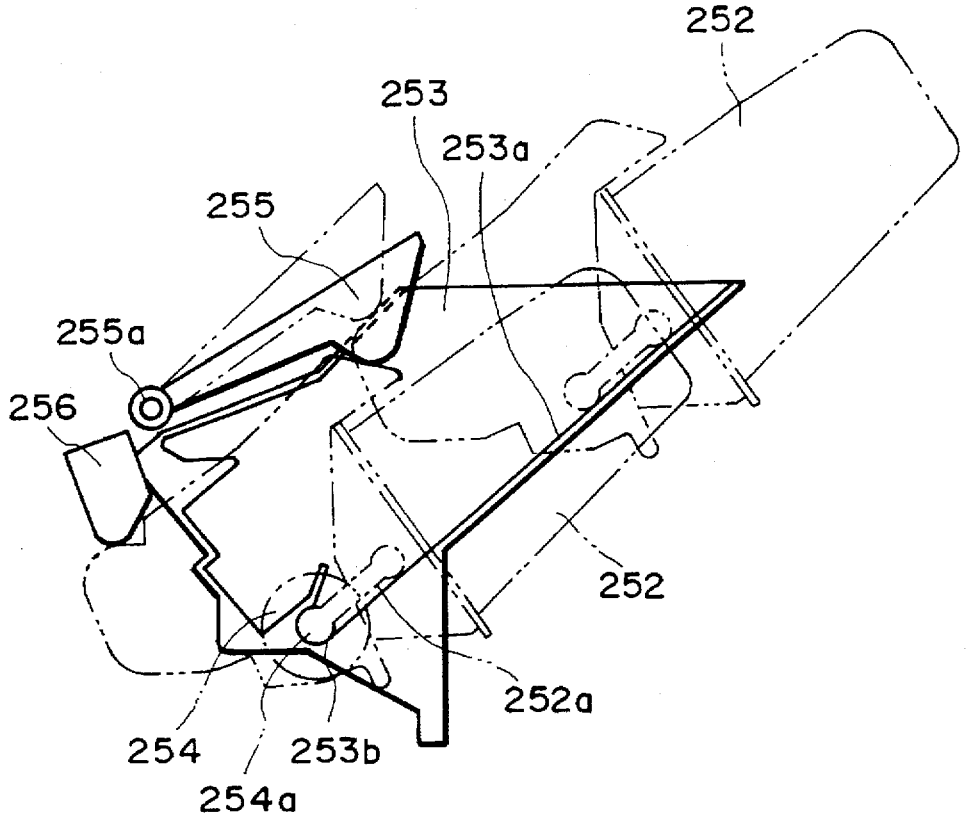
FIG. 29 is a side view showing the loading/unloading operation of the process cartridge, for explaining the background technology of the present invention.
Figure 30:
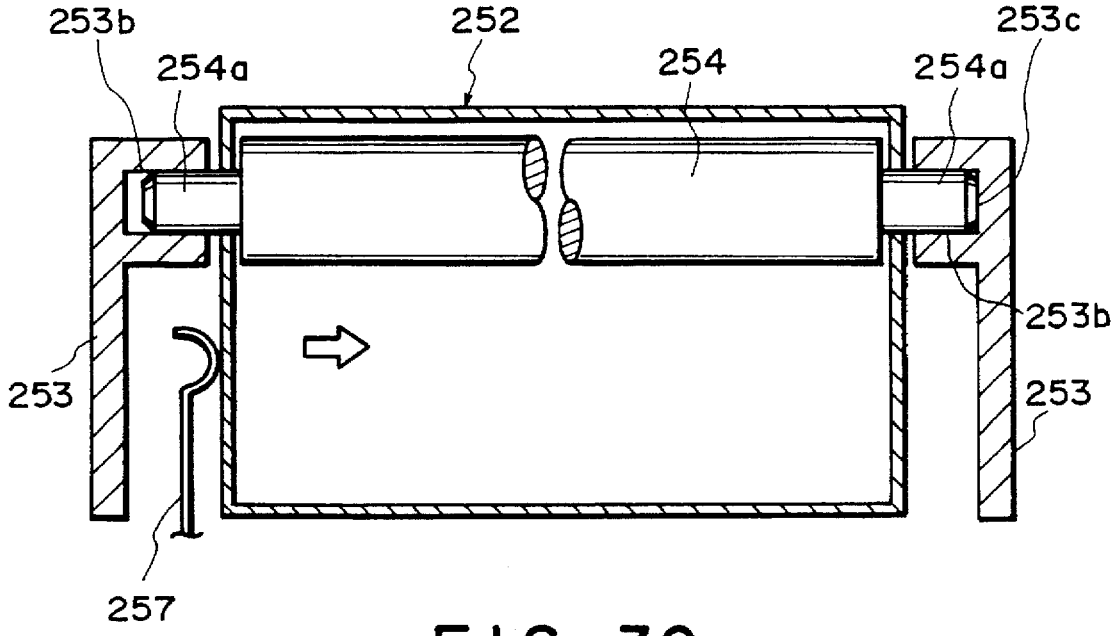
FIG. 30 is a sectional view of the process cartridge in the loaded state, for explaining the background technology of the present invention.

Next, the eighth preferred embodiment in accordance with the present invention is explained, referring to FIG. 27.

In the figure, the positioning member (second engaged member) 126 is supported by the apparatus main assembly, so that it can freely rotate around the rotative shaft 126*a*, and the thrust rail section 126*b* is formed at one end of this positioning member 126. This thrust rail section 126*b* engages with the thrust guide section 112*b* provided on the process cartridge 112 which comes sliding into the apparatus main assembly 100, thereby regulating the position of the process cartridge 112 in the thrust direction. Also, on the other end of the positioning member 126, the positioning section 126*c* which fits into the concave section 112*c* formed on the upper wall section of the process cartridge 112 is provided. As the process cartridge 112 slides along, the positioning member 126 rotates in the counterclockwise direction, whereby the engagement between the thrust rail section 126*b* and the thrust guide section 112*b* is broken.

With the above arrangement, the positioning of the process cartridge 112 in the thrust direction is carried out based on the engagement between the thrust guide section 112*b* and the thrust rail section 126*b*.

Moreover, at the final stage when the loading of the process cartridge 112 is completed, the thrust rail section 126*b* and the thrust guide section 112*b* are not in the engaged state, and the force in the thrust direction is not imparted on the process cartridge. Therefore, it is not necessary to increase the rigidity of the process cartridge 112 more than usual, and also, the positioning by the positioning section 115 is accurately carried out.

Incidentally, the so-called process cartridge in each of the above mentioned preferred embodiments is a cartridge which is realized by integrating a charging device, developing device, cleaning device, and photosensitive drum into a single unit which can be loaded into or unloaded from the main assembly of an image forming apparatus (for example, developing apparatus, laser beam printer, and the like); a cartridge which is realized by integrating at least one of the charging device, developing device, and cleaning device, and the photosensitive drum into a single unit which can be loaded into and unloaded from the main assembly of the image forming apparatus (for example, copying apparatus, laser beam printer, and the like); or a cartridge which is realized by integrating at least the developing device and the photosensitive drum into a single unit which can be loaded into or unloaded from the apparatus main assembly (for example, copying apparatus, laser beam printer, and the like).

As was described above, according to the above mentioned fifth to eighth preferred embodiments, since a sliding passage regulating means regulates the positioning of the process cartridge in the perpendicular direction to its sliding direction, the above mentioned process cartridge is loaded in its proper location within the main assembly of the image forming apparatus. Therefore, a satisfactory image is formed by these image forming apparatus.

Further, the self weight of the process cartridge is used in order for the sliding passage regulating means to regulate the positioning of the process cartridge in the direction perpendicular to its sliding direction during the process in which this process cartridge slides within the main assembly of the image forming apparatus, and at the time when this sliding movement ends, the above mentioned positioning regulation is completed.

In addition, the positioning in the sliding direction of the above mentioned process cartridge and the positioning in the direction regulated by the above mentioned sliding passage regulating means are regulated by the loaded state of this process cartridge. Therefore, in order to carry out the three-dimensional positioning of this process cartridge in the loaded state and obtain the optimum process cartridge positioning result, only one remaining positioning direction has to be taken care of. Because of this reason, the positioning in this remaining direction can be accurately carried out.

As was explained above, according to the present invention, only a simple operation is needed to load reliably the process cartridge into the main assembly of the image forming apparatus, without losing the proper attitude of the process cartridge.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus having a pair of pressing members, said process cartridge comprising:

an electrophotographic photosensitive member for carrying a latent image thereon;

a developing sleeve for developing the latent image on said photosensitive member;

a first frame to which said developing sleeve is mounted; and a second frame to which said photosensitive member is mounted, said second frame comprising an upper surface, a first positioning latching portion formed at one substantially longitudinal end of said upper surface and substantially adjacent a leading edge of said upper surface with respect to a loading direction of said process cartridge, a second positioning latching portion formed at another substantially longitudinal end of said upper surface opposite said one longitudinal end and substantially adjacent said leading edge, said first positioning latching portion and said second positioning latching portion engaging a corresponding pair of apparatus abutments when said process cartridge is mounted in the image forming apparatus to limit pivoting of said process cartridge, a first projection disposed on said upper surface and having (i) a first upward inclined surface, (ii) a first flat surface contiguous with said first upward inclined surface, and (iii) a first downward inclined surface contiguous with said first flat surface and inclined toward said first frame, and a second projection disposed on said upper surface and having (i) a second upward inclined surface, (ii) a second flat surface contiguous with said second upward inclined surface, (iii) a second downward inclined surface contiguous with said second flat surface and inclined toward said first frame, and (iv) a vertical rib that forms a side wall of said second projection and extends above said second upward inclined surface, said second flat surface, and said second downward inclined surface, wherein, when said process cartridge is mounted to the main assembly of the image forming apparatus, said first projection and said second projection are pressed by the pressing members.

2. A process cartridge detachably mountable to a main assembly of an image forming apparatus having a pressing member and abutment members, said process cartridge comprising:

an electrophotographic photosensitive member for carrying a latent image thereon;

a developing sleeve for developing the latent image on said photosensitive member;

a first frame to which said developing sleeve is mounted; and a second frame to which said photosensitive member is mounted, said second frame comprising a plurality of positioning grooves, for engaging the abutment members when said process cartridge is mounted in the image forming apparatus so as to limit pivoting of said process cartridge, and at least one projection disposed on an upper surface of said second frame and extending toward said first frame, said at least one projection having (i) an upward inclined surface, (ii) a flat surface contiguous with said upward inclined surface, and (iii) a downward inclined surface contiguous with said flat surface and inclined toward said first frame, wherein, when said process cartridge is mounted to the main assembly of the image forming apparatus, said at least one projection is pressed by the pressing member.

3. A process cartridge detachably mountable to an image forming apparatus having a first pressing member, a second pressing member, and a corresponding pair of apparatus abutments, said process cartridge comprising:

an electrophotographic photosensitive drum for carrying a latent image thereon;

a developing sleeve for developing the latent image on said photosensitive drum;

a first frame to which said developing sleeve is mounted; and a second frame to which said photosensitive drum is mounted, said second frame comprising an upper surface, a first positioning latching portion formed at one substantially longitudinal end of said upper surface and substantially adjacent a leading edge of said upper surface with respect to a loading direction of said process cartridge, a second positioning latching portion formed at another substantially longitudinal end of said upper surface opposite said one longitudinal end and substantially adjacent said leading edge, said first positioning latching portion and said second positioning latching portion engaging the corresponding pair of apparatus abutments when said process cartridge is mounted in the image forming apparatus to limit pivoting of said process cartridge, a first projection disposed on said upper surface and having (i) a first upward inclined surface, (ii) a first flat surface contiguous with said first upward inclined surface, and (iii) a first downward inclined surface contiguous with said first flat surface and inclined toward said first frame, and a second projection disposed on said upper surface and having (i) a second upward inclined surface, (ii) a second flat surface contiguous with said second upward inclined surface, (iii) a second downward inclined surface contiguous with said second flat surface and inclined toward said first frame, and (iv) a vertical rib that forms a side wall of said second projection and extends above said second upward inclined surface, said second flat surface, and said second downward inclined surface, said vertical rib engaging a side surface of the second pressing member when said process cartridge is being mounted to the image forming apparatus, wherein, when said process cartridge is mounted to the image forming apparatus, said first projection is pressed by the first pressing member and said second projection is pressed by the second pressing member, and said first positioning latching portion and said second positioning latching portion are engaged to the corresponding pair of apparatus abutments.

4. An electrophotographic process cartridge for use with an electrophotographic image forming apparatus having a cavity to removably receive said process cartridge in an operative position, said process cartridge comprising:

a casing having:

a front portion in which a rotatable photosensitive drum extending in a traverse direction of said casing and having a driven gear disposed coaxially thereon is mounted;

a rear portion constructed to form a grip for an operator to grasp when inserting said process cartridge into and removing said process cartridge from the image forming apparatus;

a first opening for allowing light to pass to the photosensitive drum to form a latent image thereon;

a second opening for transferring developed images from the photosensitive drum to a transfer material;

a first guide projection disposed on one side of said casing and spaced forwardly from said rear portion of said casing for engaging an apparatus guide provided in the image forming apparatus to guide said process cartridge during insertion of said process cartridge into the apparatus and permitting pivoting of said process cartridge when said process cartridge is in the operative position;

a pair of rearwardly directed latching portions disposed at a top surface of said casing and towards said front portion of said casing and spaced apart in a transverse direction of said casing for engaging a corresponding pair of apparatus abutments when said process cartridge is in the operative position to limit pivoting of said process cartridge about a pair of apparatus supports; and a pair of ramped portions disposed at said top surface of said casing adjacent opposite sides of said casing and rearwardly of said pair of rearwardly directed latching portions for engaging a spring-loaded pressing member of the apparatus as said process cartridge is inserted into the cavity, wherein said pair of ramped portions have (i) an upward inclined surface, (ii) a flat surface contiguous with said upward inclined surface, and (iii) a downward inclined surface contiguous with said flat surface and inclined toward said rear portion, wherein a process device comprising at least one of a charging member, a developing member, and a cleaning member are disposed in said casing for acting on the photosensitive drum; and a pair of process cartridge supports disposed at opposite ends of the photosensitive drum for engaging the pair of apparatus supports when said process cartridge is in the operative position for supporting said process cartridge in the operative position while allowing said process cartridge to pivot about the pair of apparatus supports, wherein said process cartridge is adapted to be removably inserted into the cavity of the image forming apparatus in an insertion direction substantially extending from said rear portion to said front portion of said casing and traverse to an axial direction of the photosensitive drum, and wherein, when said process cartridge is in the operative position with said pair of process cartridge supports supported by the pair of apparatus supports, forces applied to said pair of ramp portions produce a moment about said pair of process cartridge supports to urge said pair of rearwardly directed latching portions against the pair of apparatus abutments so as to define the operative position of said process cartridge and to hold said process cartridge in the operative position.

5. An image forming apparatus to which a process cartridge is detachably mountable, said image forming apparatus comprising:

a pair of pressing members;

a pair of apparatus abutments; and a mounting structure for mounting a process cartridge thereon, the process cartridge having an electrophotographic photosensitive member for carrying a latent image thereon; a developing sleeve for developing the latent image on the photosensitive member; a first frame to which the developing sleeve is mounted; and a second frame to which the photosensitive member is mounted, the second frame comprising an upper surface, a first positioning latching portion formed at one substantially longitudinal end of the upper surface and substantially adjacent a leading edge of the upper surface with respect to a loading direction of the process cartridge, a second positioning latching portion formed at another substantially longitudinal end of the upper surface opposite the one longitudinal end and substantially adjacent the leading edge, the first positioning latching portion and the second positioning latching portion engaging said pair of apparatus abutments when the process cartridge is mounted in said image forming apparatus to limit pivoting of the process cartridge, a first projection disposed on the upper surface and having (i) a first upward inclined surface, (ii) a first flat surface contiguous with the first upward inclined surface, and (iii) a first downward inclined surface contiguous with the first flat surface and inclined toward the first frame, and a second projection disposed on the upper surface and having (i) a second upward inclined surface, (ii) a second flat surface contiguous with the second upward inclined surface, (iii) a second downward inclined surface contiguous with the second flat surface and inclined toward the first frame, and (iv) a vertical rib that forms a side wall of the second projection and extends above the second upward inclined surface, the second flat surface, and the second downward inclined surface, wherein, when the process cartridge is mounted to said image forming apparatus, the first projection and the second projection are pressed by said pair of pressing members.

6. A process cartridge detachably mountable to a main assembly of an image forming apparatus having a pressing member and an abutment member, said process cartridge comprising:

an electrophotographic photosensitive drum for carrying a latent image thereon;

a charging member for charging said electrophotographic photosensitive drum;

a developing sleeve for developing the latent image carried on said electrophotographic photosensitive drum;

a first frame to which said developing sleeve is mounted; and a second frame to which said electrophotographic photosensitive drum and said charging member are mounted, said second frame comprising a positioning portion, for engaging the abutment member when said process cartridge is mounted in the image forming apparatus so as to limit pivoting of said process cartridge, and at least one projection disposed on an upper surface of said second frame and extending toward said first frame, said at least one projection being projected from said upper surface of said second frame, wherein when said process cartridge is mounted to the image forming apparatus, said at least one projection is pressed by the pressing member, and said positioning portion is engaged with the abutment member.

* * * * *

UNITED STATES PATENT AND TRADEMARK OFFICE

CERTIFICATE OF CORRECTION

PATENT NO. : 5,734,949

DATED : March 31, 1998

INVENTOR(S) : SHINJI GOTO ET AL.

It is certified that error appears in the above-identified patent and that said Letters Patent is hereby corrected as shown below:

COLUMN 6

Line 31, "and" should read --to--.

COLUMN 10

Line 22, "show" should read --shown--.

COLUMN 11

Line 18, "33a" should read --33a,--.

Line 19, "of," should read --of--.

COLUMN 12

Line 41, "On" should read --On--.

COLUMN 14

Line 35, "transfer" should read --transfers--.

UNITED STATES PATENT AND TRADEMARK OFFICE

CERTIFICATE OF CORRECTION

PATENT NO. : 5,734,949

DATED : March 31, 1998

INVENTOR(S) : SHINJI GOTO ET AL.

It is certified that error appears in the above-identified patent and that said Letters Patent is hereby corrected as shown below:

COLUMN 19

Line 6, "these" should read --the--.

Signed and Sealed this

Twelfth Day of January, 1999

*Attest:*

*Attesting Officer*

*Acting Commissioner of Patents and Trademarks*